US010161020B2

(12) United States Patent
Cheong et al.

(10) Patent No.: US 10,161,020 B2
(45) Date of Patent: Dec. 25, 2018

(54) RECRYSTALLIZED ALUMINUM ALLOYS WITH BRASS TEXTURE AND METHODS OF MAKING THE SAME

(75) Inventors: Soonwuk Cheong, Pittsburgh, PA (US); Roberto J. Rioja, Murrysville, PA (US); Paul E. Magnusen, Pittsburgh, PA (US); Cagatay Yanar, Bethel Park, PA (US); Dirk C. Mooy, Bettendorf, IA (US); Gregory B. Venema, Bettendorf, IA (US); Edward Llewellyn, Murrysville, PA (US)

(73) Assignee: ARCONIC INC., Pittsburgh, PA (US)

( * ) Notice: Subject to any disclaimer, the term of this patent is extended or adjusted under 35 U.S.C. 154(b) by 2069 days.

(21) Appl. No.: 11/865,526

(22) Filed: Oct. 1, 2007

(65) Prior Publication Data

US 2009/0084474 A1 Apr. 2, 2009

(51) Int. Cl.

| | |
|---|---|
| ***C22C 21/12*** | (2006.01) |
| ***C22C 21/16*** | (2006.01) |
| ***C22C 21/18*** | (2006.01) |
| ***C22C 21/00*** | (2006.01) |
| ***C22F 1/04*** | (2006.01) |

(52) U.S. Cl.
CPC ..... *C22C 21/00* (2013.01); *C22C 21/12* (2013.01); *C22F 1/04* (2013.01)

(58) Field of Classification Search
CPC ..... C22C 21/12; C22C 21/16; C22C 21/18
USPC ..... 148/693, 437, 438
See application file for complete search history.

(56) References Cited

U.S. PATENT DOCUMENTS

| | | | | |
|---|---|---|---|---|
| 3,310,389 | A | 3/1967 | Doyle et al. | 29/197.5 |
| 4,092,181 | A | 5/1978 | Paton et al. | 148/12.7 |
| 4,988,394 | A | 1/1991 | Cho | 148/12.7 |
| 6,117,252 | A | 9/2000 | Barlat et al. | 148/439 |
| 6,221,182 | B1 | 4/2001 | Barlat et al. | 148/439 |
| 6,231,809 | B1 | 5/2001 | Matsumoto et al. | 420/535 |
| 6,334,916 | B1 | 1/2002 | Matsumoto et al. | 148/437 |
| 6,562,154 | B1 | 5/2003 | Rioja et al. | 148/415 |
| 6,652,678 | B1 | 11/2003 | Marshall et al. | 148/552 |
| 6,991,689 | B2 | 1/2006 | Vine et al. | 148/693 |
| 7,744,704 | B2 | 6/2010 | Bes et al. | |

(Continued)

FOREIGN PATENT DOCUMENTS

| | | |
|---|---|---|
| DE | 199 38 995 | 3/2001 |
| EP | 0480402 | 4/1992 |

(Continued)

OTHER PUBLICATIONS

"Effects of Texture on Mechanical Properties of Aluminum Alloy Sheets and Texture Optimization Strategy", Proceedings of the 6th International Conference and Workshop on Numerical Simulation of 3D Sheet Metal Forming Process, vol. 778, (2005), 445-450.*

(Continued)

*Primary Examiner* — Matthew E Hoban
(74) *Attorney, Agent, or Firm* — Greenberg Traurig, LLP

(57) ABSTRACT

A recrystallized aluminum alloy having brass texture and Goss texture, wherein the amount of brass texture exceeds the amount of Goss texture, and wherein the recrystallized aluminum alloy exhibits at least about the same tensile yield strength and fracture toughness as a compositionally equivalent unrecrystallized alloy of the same product form and of similar thickness and temper.

23 Claims, 22 Drawing Sheets

(56) References Cited

U.S. PATENT DOCUMENTS

| | | | | |
|---|---|---|---|---|
| 2004/0187985 | A1 | 9/2004 | Matsumoto et al. | 148/692 |
| 2007/0128463 | A1* | 6/2007 | Dixon et al. | 428/654 |

FOREIGN PATENT DOCUMENTS

| | | |
|---|---|---|
| EP | 1144704 B1 | 3/2004 |
| JP | 08-325663 | 12/1996 |
| JP | 08325663 | 12/1996 |
| JP | 2000080431 | 3/2000 |
| WO | WO 95/25825 | 9/1995 |
| WO | WO 00/52219 | 9/2000 |
| WO | WO2006/131627 | 12/2006 |

OTHER PUBLICATIONS

Machine translation of JP 08325663, 1996.*

International Search Report and Written Opinion from corresponding International Application No. PCT/US2008/073130, dated Nov. 3, 2008.

Jata K. V. et al. "The Anisotropy and Texture of Al-Li Alloys" Materials Science Forum, Aedermannsfdorf, CH, vol. 217-222, Jan. 1, pp. 647-652, XPOOI056457 ISSN: 0255-5476.

Rioja et al. "The Role of Crystallographic Texture on the Performance of Flat Rolled Aluminum Products for Aerospace Applications" Light Metals (Warrendale, PA, United States) 1065-1069 Coden: LMPMDF; ISSN: 0147-0809, 2008, XP009107161.

Van Geertruyden et al."Formation of recrystallization textures after hot working of AA2014 and AA6063" Materials Science Forum, 408-412(Pt. 1, Textures of Materials), 845-850 Coden: MSFOEP; ISSN: 0255-5476, 2002, XP009107167.

Cullity, et al. "Elements of X-ray diffraction," pp. 303-308, Prentice Hall (2001).

Humphreys, et al., "Recrystallization and Related Annealing Phenomena," pp. 1-3, Elsevier Ltd. (1995).

Kocks, et al., Texture and Anistropy, Preferred Orientations in Polycrystals and their Effect on Material Properties, pp. 140-141, 182-185, Cambridge University Press (1998).

Liu, "Texture and Grain Boundary Evolutions of Continuous Cast and Direct Chill Cast AA 5052 Aluminum Alloy During Cold Rolling," pp. 1-6. [retrieved from the Internet on Jul. 3, 2007] http://www.tms.org/Students/Winners/Liu/Liu.html.

Radhakrishnan, et al., "Optimization of Microstructure-Property Relationship in Materials," pp. 1-8. [retrieved from the Internet on Aug. 22, 2007] http://www.ornl.gov/info/ornlreview/v30n3-4/optim.htm.

Rioja, "Fabrication methods to manufacture isotropic Al-Li alloys and products for space and aerospace applications," *Materials Science and Engineering A* 257(1): 100-107 (1998).

ASM Specialty Handbook: Aluminum and Aluminum Alloys, ASM International, Materials Park, OH 44073-0002, pp. 18 and 59 (1993).

Registration Record Series Teal Sheets, International Alloy Designations and Chemical Compositions Limits for Wrought Aluminum and Wrought Aluminum Alloys, The Aluminum Association, Inc., Arlington, Virginia, U.S.A., pp. 1-28 (Feb. 2009).

*Aluminum: Properties and Physical Metallurgy*, edited by John E. Hatch, American Society for Metals, Materials Park, OH, pp. 116-127, 152-157, and 177-194 (1984).

Giummarra, C., et al., "Development of Corrosion Resistant, High Toughness Aluminum-Lithium Aerospace Alloys," 11$^{th}$ International Conference on Aluminium Alloys, Sep. 22-26, 2008, Aachen Germany.

Opposition letter to European Patent 2212444, dated Jul. 7, 2014, 7 pages.

Affidavit of Bernard Bes, dated Jul. 4, 2014, accompanying opposition letter to European Patent No. 2212444, 4 pages.

Letter dated Jul. 10, 2015, filed by Opponent, in the Opposition from corresponding European Patent No. 2212444, with English translation.

Barlat, F., et al., "On Crystallographic Texture Gradient and its Mechanical Consequence in Rolled Aluminum-Lithium Sheet", *Scripta Metallurgica et Materialia,* vol. 27, pp. 1121-1126, 1992.

Zeng, X. H., et al., "Texture gradient, average texture, and plastic anisotropy in various Al—Li sheet alloys", *Materials Science and Technology,* vol. 10, pp. 581-591, Jul. 1994.

Affidavit of Dr. Nicholas Bayona-Carillo, dated Oct. 28, 2016, filed in related European Patent Application No. 08797870.6 (publication No. EP2212444), 2 pages.

Affidavit of Bernard Bes, dated Jul. 5, 2015, filed in related European Patent Application No. 08797870.6 (publication No. EP2212444), 4 pages.

Affidavit of Philippe Bridot, dated Jul. 9, 2015, filed in related European Patent Application No. 08797870.6 (publication No. EP2212444), 4 pages.

Gulyaev, P., Metal Science, Moscow Metallurgy, pp. 490-491, 493-494, 496, 499, 1986, cited in related Russian Patent Application No. 2010117372, (English Translation).

* cited by examiner

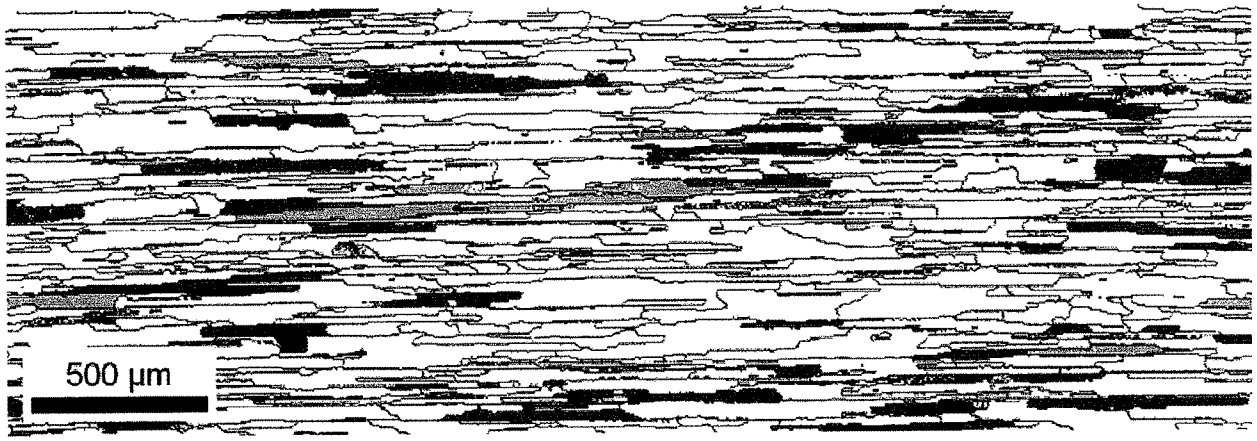

(Highlighted Points)/(Total Number of Points) = 0.000
(Highlighted Points)/(Number of Good Points) = 0.000
(Highlighted Points)/(Number of Partition Points) = 0.000

Gray Scale Map Type:<none>

Color Coded Map Type: Crystal Orientation

| Orientation Euler Angles | Orientation (hkl)[uvw] | Min | Max | Total Fraction | Partition Fraction |
|---|---|---|---|---|---|
| (35.0, 45.0, 0.0) | (0 1 1)[2 -1 1] | 0° | 15° | 0.113 | 0.113 |
| (0.0, 45.0, 0.0) | (0 1 1)[1 0 0] | 0° | 15° | 0.024 | 0.024 |

Boundaries: Rotation Angle

| Min | Max | Fraction | Number | Length |
|---|---|---|---|---|
| 15° | 180° | 0.789 | 86855 | 25.07 cm |

*For statistics - any point pair with misorientation exceeding 2° is considered a boundary
total number = 110082, total length = 31.78 cm)

FIG. 8

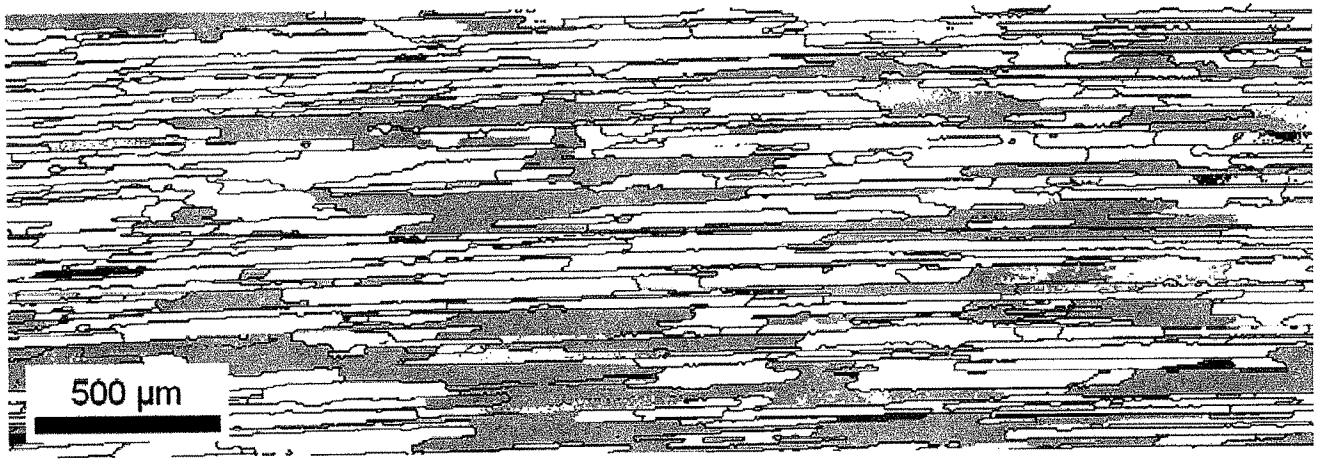

(Highlighted Points)/(Total Number of Points) = 0.000
(Highlighted Points)/(Number of Good Points) = 0.000
(Highlighted Points)/(Number of Partition Points) = 0.000

Gray Scale Map Type:<none>

Color Coded Map Type: Crystal Orientation

| Orientation Euler Angles: | Orientation (hkl(0))<uvw(1)> | Min | Max | Total Fraction | Partition Fraction |
|---|---|---|---|---|---|
| (35.0, 45.0, 0.0) | (0 1 1)[2 -1 1] | 0° | 15° | 0.007 | 0.007 |
| (0.0, 45.0, 0.0) | (0 1 1)[1 0 0] | 0° | 15° | 0.283 | 0.283 |

Boundaries: Rotation Angle

| Min | Max | Fraction | Number | Length |
|---|---|---|---|---|
| 15° | 180° | 0.786 | 39921 | 19.66 cm |

*For statistics - any point pair with misorientation exceeding 2° is considered a boundary
total number = 50003, total length = 25.00 cm)

FIG. 9

RECRYSTALLIZED ALUMINUM ALLOYS WITH BRASS TEXTURE AND METHODS OF MAKING THE SAME

BACKGROUND

Aluminum alloy pieces may be produced via rolling, extrusion or forging processes. As a result of manipulating the shape of the aluminum alloy pieces, or through the cooling of molten aluminum, undesirable mechanical properties and stresses may be induced in the alloy. Heat treating encompasses a variety of processes by which changes in temperature of the metal are used to improve the mechanical properties and stress conditions of the alloy. Solution heat treatment, quenching, precipitation heat treatment, and annealing are all different methods used to heat treat aluminum products.

SUMMARY OF THE INVENTION

Broadly, the present invention relates to aluminum alloy products having a recrystallized microstructure containing relatively high amounts of brass texture relative to Goss texture, and methods for producing the same. The aluminum alloy products may exhibit an improved strength to toughness relationship compared to conventional products produced with conventional methods.

In one aspect, recrystallized aluminum alloys are provided. In one approach, a recrystallized aluminum alloy has brass texture and Goss texture, and the amount of brass texture exceeds the amount of Goss texture. In one embodiment, the amount of brass texture is at least 2 times greater than the amount of Goss texture. In one embodiment, the amount of brass texture relative to Goss texture is determined by comparing the measured brass texture intensity to the measured Goss texture intensity for a given polycrystalline sample, as determined using x-ray diffraction techniques. In another embodiment, the amount of brass texture relative to Goss texture is determined by comparing the area fraction of brass oriented grains to the area fraction of Goss oriented grains for a given polycrystalline sample using orientation imaging microscopy. In one embodiment, the area fraction of brass oriented grains for a given polycrystalline sample is at least about 10%. In one embodiment, the area fraction of Goss oriented grains for a given polycrystalline sample is not greater than about 5%. In one embodiment, a recrystallized sheet product has a maximum R-value (also known as "Lankford coefficient") in the range of from about 40° to about 60°. In one embodiment, a product produced from the recrystallized alloy has at least about the same fracture toughness and at least about the same tensile yield strength as a compositionally equivalent unrecrystallized alloy of the same product form and of similar thickness and temper.

Various aluminum alloys compositions may be useful in accordance with the instant disclosure. In one embodiment, the recrystallized aluminum alloy is a 2XXX series aluminum alloy. In one embodiment, the recrystallized aluminum alloy is a 2199 series aluminum alloy. In one embodiment, the recrystallized aluminum alloy includes up to about 7.0 wt % copper. In one embodiment, the recrystallized aluminum alloy includes up to about 4.0 wt % lithium.

The recrystallized aluminum alloy may be utilized in a variety of industrial applications. In one embodiment, the recrystallized aluminum alloy is in the form of a sheet product. In one embodiment, the sheet product is employed in an aerospace application (e.g., a fuselage product). In other embodiments, the sheet product is employed in automotive, transportation or other industrial applications.

In one embodiment, the recrystallized aluminum alloy is a 2199 series alloy in the form of a sheet product. In this embodiment, the amount of brass texture exceeds the amount of Goss texture, and the sheet product has a thickness of not greater than about 0.35 inch, a LT tensile yield strength of at least about 370 MPa and a T-L fracture toughness (Kapp) of at least about 80 MPa(m½).

In another aspect, method of making recrystallized aluminum alloy sheet products are provided. In one approach, a method includes completing a hot rolling and a cold work step on an aluminum alloy sheet, subjecting the aluminum alloy sheet to a first recrystallization anneal, completing at least one of (i) another cold work step; and (ii) a recovery anneal step on the aluminum alloy sheet, subjecting the aluminum alloy sheet to a second recrystallization anneal, and aging the aluminum alloy sheet to produce the recrystallized aluminum sheet product.

Various ones of the inventive aspects noted hereinabove may be combined to yield various recrystallized aluminum alloy products having improved strength and/or toughness qualities, to name a few. Moreover, these and other aspects, advantages, and novel features of the invention are set forth in part in the description that follows and will become apparent to those skilled in the art upon examination of the following description and figures, or may be learned by practicing the invention.

BRIEF DESCRIPTION OF THE DRAWINGS

FIG. 8 is an OIM scanned image of a sheet product produced in accordance with embodiments of the present disclosure at the L plane of the t/2 location.

FIG. 9 is an OIM scanned image of a conventionally processed sheet product at the L plane of the /2 location

DETAILED DESCRIPTION

Aluminum and aluminum alloys are polycrystalline materials whose characteristics and arrangements can be altered by deformation of the metal (e.g., rolling, extrusion or forging) or by the application of heat (e.g., annealing). During deformation of an aluminum alloy, the free energy of the crystalline material may be raised by, for example, crystallographic slip. Crystallographic slip involves the movement of dislocations in certain planes and directions in each crystal. The occurrence of crystallographic slip during plastic deformation increases dislocation density and crystal rotation within the material. Crystal rotation accompanying deformation is one reason textures, or non-random orientations of crystals (also called grains), develop within a polycrystalline material.

Figure 1A:
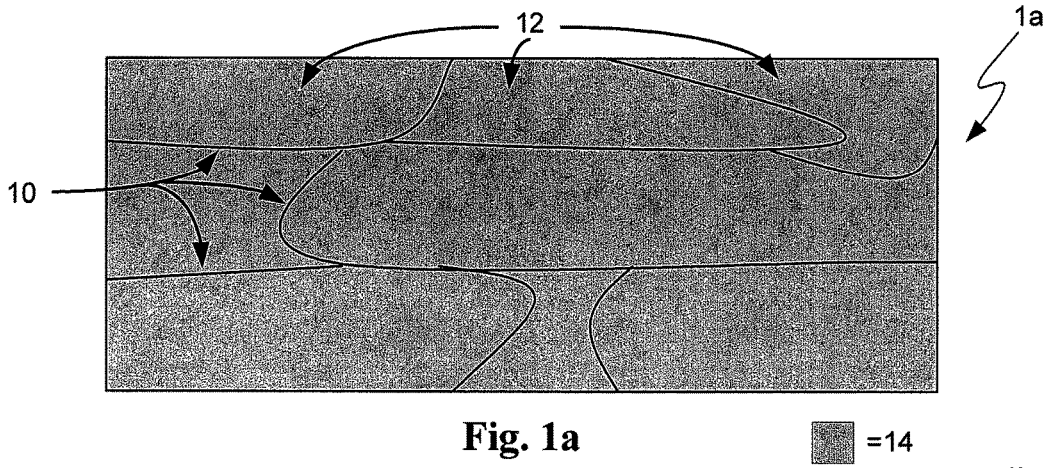
FIG. 1*a* is a schematic view of a deformed microstructure.

The microstructure of a polycrystalline material, such as an aluminum alloy, varies depending on its processing history. For example, aluminum alloys may have a deformed microstructure after deformation, a recovered microstructure after a recovery anneal, described in further detail below, and a recrystallized microstructure after a recrystallization anneal, described in further detail below. One example of a microstructure including deformed grains is illustrated in FIG. 1*a*. In the illustrated example, the microstructure 1*a* includes a plurality of deformed grains 12, each grain having a grain boundary 10. Due to deformation, the internal areas of the deformed grains 12 include a high dislocation density, represented in FIG. 1*a* as shading 14.

Figure 1B:
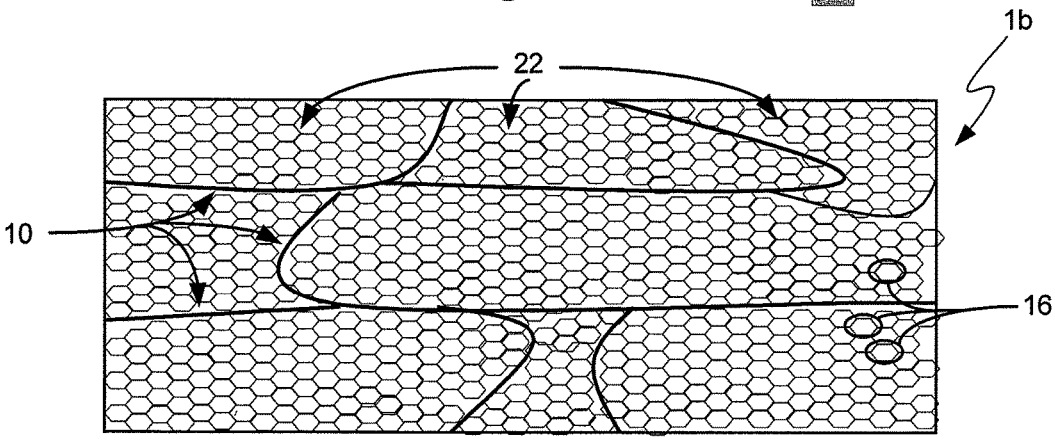
FIG. 1*b* is a schematic view of a recovered microstructure.

To reduce the free energy of a deformed material, the material may be annealed. An anneal involves heating the deformed material at elevated temperature. There are generally two types of anneals used to treat aluminum alloys: recovery anneals and recrystallization anneals. With a recovery anneal, an aluminum alloy is heated to a temperature such that the grain boundary of the deformed grain is generally maintained, but the dislocations within the deformed grains 12 move to lower energy configurations. These lower energy configurations within the grains are called sub-grains or cells. Thus, the grains produced from a recovery anneal are generally called recovered grains. One example of a microstructure including recovered grains is illustrated in FIG. 1*b*. In the illustrated example, the recovered microstructure 1*b* includes recovered grains 22. The recovered grains 22 generally have the same grain boundary 10 as the deformed grains 12, but, due to the recovery anneal, sub-grains 16 have formed within the recovered grains 12.

Figure 1C:
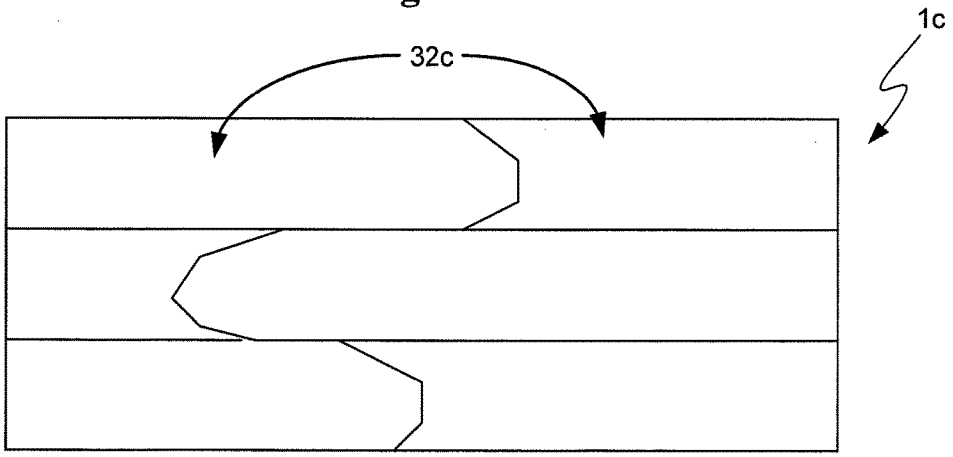
FIG. 1*c* is a schematic view of a recrystallized microstructure.
Figure 1D:
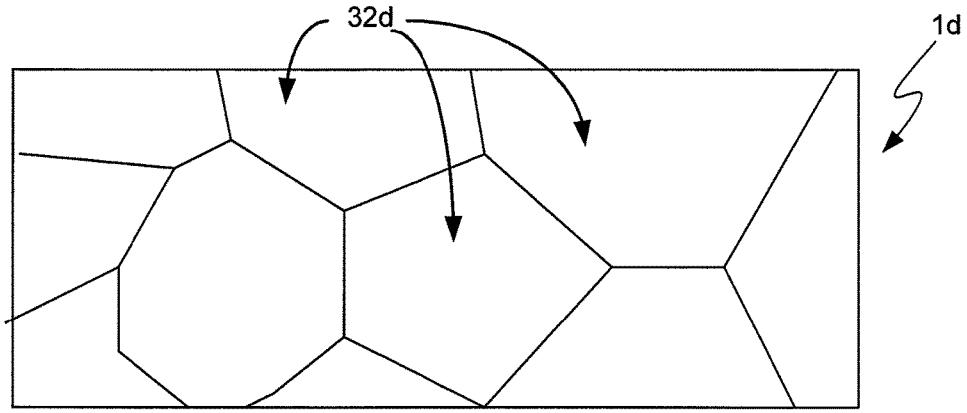
FIG. 1*d* is a schematic view of another recrystallized microstructure.
Figure 1E:
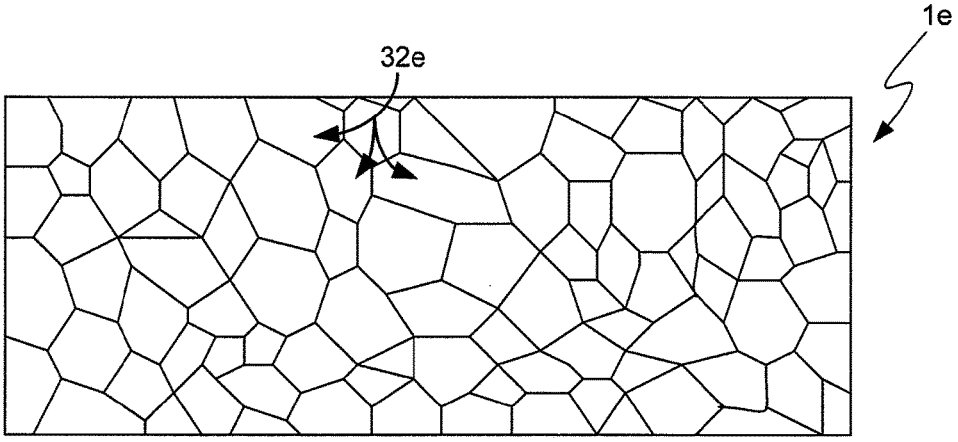
FIG. 1*e* is a schematic view of another recrystallized microstructure.

With a recrystallization anneal, the aluminum alloy is heated to a temperature that produces new grains from deformed grains 12 and/or recovered grains 22. These new grains are called recrystallized grains. A recrystallization anneal results in the production of a material having recrystallized grains. Examples of microstructures including recrystallized grains are illustrated in FIGS. 1*c*-1*e*. In the illustrated examples, microstructure 1*c* contains elongated recrystallized grains 32*c* (FIG. 1*c*), microstructure 1*d* contains large equiaxed recrystallized grains 32*d* (FIG. 1*d*), and microstructure 1*e* contains small equiaxed recrystallized grains 32*e* (FIG. 1*e*).

Recrystallization anneal conditions, aluminum alloy sheet size, and aluminum alloy composition, among others, may be tailored in an effort to obtain the desired recrystallized grain configurations. For example, elongated recrystallized grains 32*c* may be obtained from anisotropic mechanical deformation (e.g., cold rolling) and lower recrystallization temperatures. Large equiaxed recrystallized grains 32*d* may be obtained from long anneal times. Small equiaxed recrystallized grains 32*e* may be obtained from increased cold work and short anneal times.

Figure 1F:
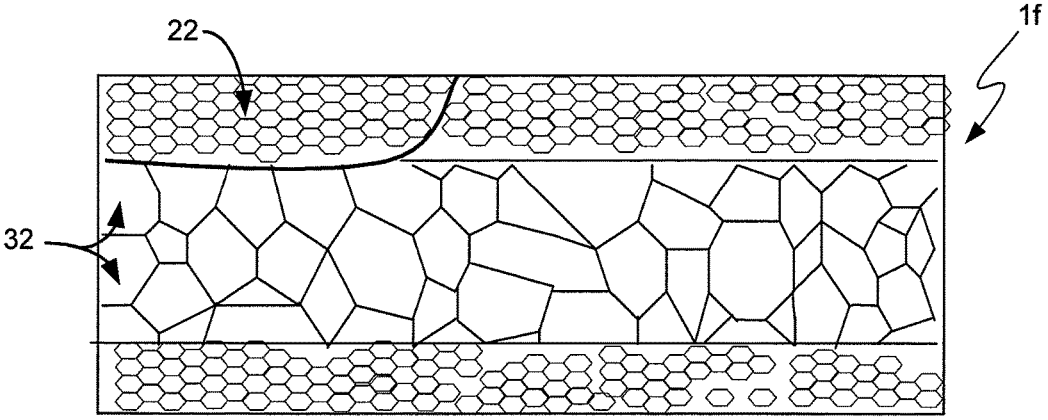
FIG. 1*f* is a schematic view of a partially recrystallized microstructure.

In some circumstances, an anneal may produce a partially recrystallized material, one example of which is illustrated in FIG. 1*f*. In the illustrated example, the partially recrystallized microstructure if includes a mixture of recovered grains 22 and recrystallized grains 32.

The grains of a deformed, recovered, recrystallized or partially recrystallized polycrystalline materials are generally oriented in non-random manners. These crystallographically non-random grain orientations are known as texture. Texture components resulting from production of aluminum alloy products may include one or more of copper, S texture, brass, cube, and Goss texture, to name a few. Each of these textures is defined in Table 1, below.

TABLE 1

| Texture type | Miller Indices | Bunge (φ1, Φ, φ2) | Kocks (Ψ, Θ, Φ) |
|---|---|---|---|
| copper | {112}⟨ 11$\bar{1}$⟩ | 90, 35, 45 | 0, 35, 45 |
| S | {123}⟨ 63$\bar{4}$⟩ | 59, 37, 63 | 149, 37, 27 |
| brass | {110}⟨ $\bar{1}$12⟩ | 35, 45, 0 | 55, 45, 0 |
| Cube | {100} <001> | 0, 0, 0 | 0, 0, 0 |
| Goss | {110}⟨ 001⟩ | 0, 45, 0 | 0, 45, 0 |

Texture is generally measured in polycrystalline materials using x-ray diffraction techniques to obtain microscopic images of the polycrystalline materials. Since the images can vary based on the amount of energy used during x-ray diffraction, the measured texture intensities are generally normalized by calculating the amount of background intensity, or random intensity, and comparing that background intensity to the intensity of the textures of the image. Thus, the relative intensities of the obtained texture measurements are dimensionless quantities that can be compared to one another to determine the relative amount of the different textures within a polycrystalline material. For example, an x-ray diffraction analysis may determine a background intensity relative to a Goss texture intensity or a brass texture intensity, and use orientation distribution functions to produce normalized Goss intensities and brass intensities. These normalized Goss and brass intensity measurements may be utilized to determine the relative amounts of Goss texture and brass texture for a given polycrystalline material.

The crystallographic texture may also be measured using Orientation Imaging Microscopy (OIM). When the beam of a Scanning Electron Microscope (SEM) strikes a crystalline material mounted at an incline (e.g., around 70°), the electrons disperse beneath the surface, subsequently diffracting among the crystallographic planes. The diffracted beam produces a pattern composed of intersecting bands, termed electron backscatter patterns, or EBSPs. EBSPs can be used to determine the orientation of the crystal lattice with respect to some laboratory reference frame in a material of known crystal structure.

In view of the foregoing, the following definitions are used herein:

"Grain" means a crystal of a polycrystalline material, such as an aluminum alloys.

"Deformed grains" means grains that are deformed due to deformation of the polycrystalline material.

"Dislocation" means an imperfection in the crystalline structure of the material resulting from the dislocated atomic arrangement in one or more layers of the crystalline structure. Deformed grains may be defined by cells of dislocations, and thus deformed grains generally have a high dislocation density.

"Recovered grains" means grains that are formed from deformed grains. Recovered grains generally have the same grain boundary as deformed grains, but generally have a lower free energy than deformed grains due to the formation of sub-grains from the dislocations of the deformed grains. Thus, recovered grains generally have a lower dislocation density than deformed grains. Recovered grains are generally formed from a recovery anneal.

"Recrystallized grains" means new grains that are formed from deformed grains or recovered grains. Recrystallized grains are generally formed from a recrystallization anneal.

"Recrystallized material" means a polycrystalline material predominately containing recrystallized grains. In one embodiment, at least about 60% of the recrystallized material comprises recrystallized grains. In other embodiments, at least about 70%, 80% or even 90% of the recrystallized material comprises recrystallized grains. Thus, the recrystallized material may include a substantial amount of recrystallized grains.

"Recrystallized aluminum alloy" means an aluminum alloy product composed of a recrystallized material.

"Unrecrystallized grains" means grains that are either deformed grains or recovered grains.

"Unrecrystallized material" means a polycrystalline material including a substantial amount of unrecrystallized grains.

"Recovery anneal" means a processing step that produces an end product having a substantial amount of recovered grains. A recovery anneal thus generally produces an unrecrystallized material. A recovery anneal may involve heating a deformed material.

"Recrystallization anneal" means a processing step that produces a recrystallized material. A recrystallization anneal may involve heating a deformed and/or recovered material.

"Hot rolling" means a thermal-mechanical process that is performed at an elevated temperature to deform the metal. Hot rolling is also known to those skilled in the art as dynamic recovery. Hot rolling generally does not result in the production of recrystallized grains, but instead generally results in the production of deformed grains. In this regard, a hot rolled sheet product generally exhibits a deformed microstructure, as illustrated in FIG. 1*a*, above.

"Cold work" means deformation processes applied to an aluminum alloy at about ambient temperatures to deform the metal into another shape and/or thickness. Deformation processes include rolling, extrusion and forging. The cold work step may include cross-rolling or unidirectional rolling.

"Microstructure" means the structure of a polycrystalline sample as viewed via microscopic images. The microscopic images generally at least communicate the types of grains included in the material. With respect to the present disclosure, microstructures may be obtained from a properly prepared sample (e.g., see the preparation technique described with respect to texture intensity measurements) and with a polarized beam (e.g., via a Zeiss optical microscope) at a magnification of from about 150× to about 200×.

"Deformed microstructure" means a microstructure including deformed grains.

"Recovered microstructure" means a microstructure including recovered grains.

"Recrystallized microstructure" means a microstructure including recrystallized grains.

"Texture" means the crystallographic orientation of grains within a polycrystalline material.

"Goss texture" is defined in Table 1, above.

"Brass texture is defined in Table 1, above.

"Fraction of Goss texture" means the area fraction of Goss oriented grains of a given polycrystalline sample as calculated using orientation imaging microscopy using, for example, the OIM sample procedure, described below.

"Fraction of brass texture" means the area fraction of brass oriented grains of a given polycrystalline sample as calculated using orientation imaging microscopy using, for example, the OIM sample procedure, described below.

The "OIM sample procedure" is a follows: the software used is the TexSEM Lab OIM DC version. 4.0 (EDAX Inc., New Jersey, U.S.A.), which is connected via FIREWIRE (Apple, Inc., California, U.S.A.) to a DigiView 1612 CCD camera (TSL/EDAX, Utah, U.S.A.). The SEM is a JEOL 840 (JEOL Ltd. Tokyo, Japan). OIM run conditions are 70° tilt with a 15 mm working distance at 25 kV with dynamic focusing and spot size of 1×10-7 amp. The mode of collection is a square grid. Only orientations are collected (i.e., Hough peaks information is not collected). The area size per scan is 3500 μm×600 μm at 5 μm steps at 75×. Four scans per sample are performed. The total scan area is set to contain more than 1000 grains for texture analysis. The scans are conducted at the L plane at the t/2 location. The obtained data are processed with a multiple-iteration dilation cleanup with a 5° grain tolerance angle and 3 points per grain minimum grain size (15 μm). The grain boundary map assumes a misorientation angle of 15°. The crystal orientation maps assumes Euler angles of $\varphi1=35°$ $\Phi=45°$ $\varphi2=0°$ (±15° misorientation angle) for the brass texture component and φ1=0° Φ=45° φ2=0° (±15° misorientation angle) for the Goss texture component.

"Texture intensity" means a measured amount of x-ray diffraction associated with a specific texture for a given polycrystalline sample. Texture intensity may be measured via x-ray diffraction and in accordance with "*Texture and Anisotropy, Preferred Orientations in Polycrystals and their Effect on Material Properties*", Kocks et al., pp. 140-141, Cambridge University Press (1998). The absolute intensity values of texture components measured may vary among institutes, due to hardware and/or software differences, and thus the ratios of the texture intensities are used in accordance with the instant disclosure. Texture intensities may be obtained as provided by the "Texture intensity measurement procedure", described below.

The "texture intensity measurement procedure" is as follows: samples are prepared by polishing with Buehler Si—C paper by hand for 3 minutes, followed by polishing by hand with a Buehler diamond liquid polish having an average particle size of about 3 μm. The samples are anodized in an aqueous fluoric-boric solution for 30-45 seconds. The texture intensities are measured using a Rigaku Geigerflex x-ray diffraction apparatus (Rigaku, Tokyo JAPAN), where the {111}, {200}, and {220} pole figures are measured up to the maximum tilt angle of 75° by the Schulz back-reflection method using CuKα radiation, and then updated pole figures are obtained after defocusing and background corrections of the raw pole figure data, and then orientation distribution functions (ODFs) are calculated from the updated three pole figure data using appropriate software, such as the "popLA" software, available from Los Alamos National Laboratory, New Mexico, United States of America.

"Goss texture intensity" means the texture intensity associated with a Goss texture for a given polycrystalline sample.

"Brass texture intensity" means the texture intensity associated with a brass texture for a given polycrystalline sample.

"Amount of Goss texture" means either (i) the measured amount of Goss texture intensity for a given polycrystalline sample as measured via x-ray diffraction, or (ii) the area fraction of Goss texture of a given polycrystalline sample as measured using orientation imaging microscopy (OIM).

"Amount of brass texture" means either (i) the measured amount of brass texture intensity for a given polycrystalline sample as measured via x-ray diffraction, or (ii) the area fraction of brass texture of a given polycrystalline samples as measured using orientation imaging microscopy (OIM).

"Unrecrystallized alloy" means an alloy containing a substantial amount of unrecrystallized grains, or an alloy subjected to only a single recrystallization anneal via a solution heat treatment step.

Aluminum alloys within the scope of the present disclosure having a higher amount of brass texture than Goss texture may exhibit an improved strength to toughness relationship compared to conventionally produced products. Hence, the present disclosure relates to recrystallized aluminum alloys having a higher amount of brass texture than Goss texture. Products produced from the recrystallized alloys generally have at least about the same fracture toughness and at least about the same tensile yield strength as a compositionally equivalent unrecrystallized alloy of the same product form and of similar thickness and temper. Mechanical, thermo-mechanical and/or thermal process may be tailored to produce recrystallized aluminum alloys having a relatively high amount of brass texture. In one approach, hot and/or cold work steps (e.g., rolling) are employed in combination with at least one intermediate recrystallization anneal and a final recrystallization anneal (e.g., a solution heat treatment step) to produce recrystallized aluminum alloys having a high amount of brass texture. Additional tempering operations may be employed after solution heat treatment to further develop the desired properties of the recrystallized aluminum alloys.

The amount of brass texture of the recrystallized aluminum alloy generally exceeds the amount of Goss texture of the recrystallized aluminum alloy. In one embodiment, the amount of brass texture and the amount of Goss texture are determined using orientation imaging microscopy techniques, as described above. In one embodiment, the area fraction of brass texture is at least about 10%. In one embodiment, the area fraction of Goss texture is not greater than about 5%.

In one embodiment, the ratio of the amount of brass texture to the amount of Goss texture in a recrystallized aluminum alloy is at least about 1, as determined from the area fraction of brass oriented grains and the area fraction of Goss orientated grains. In one embodiment, the ratio of the area fraction of brass oriented grains (BVF) to the area fraction of Goss oriented grains (GVF) in a recrystallized aluminum alloy is at least about 1.5:1 (BVF:GVF). In other embodiments, the ratio of brass texture intensity to Goss texture intensity in a recrystallized aluminum alloy is at least about 1.75:1 (BVF:GVF), or at least about 2:1 (BVF:GVF).

In one embodiment, a recrystallized aluminum alloy exhibits a maximum R-value in the range of from about 40° to 60°. The "R-value", or "Lankford Coefficient" presents the plastic strain ratio expressed as:

$$R = \frac{e_w}{e_t}$$

where $e_w$ is the true width strain (in the sheet plane at 90° to the tensile axis) and $e_t$ is the true thickness strain. R-values may be measured in accordance with ASTM E517-00(2006) e1, Sep. 1, 2006. Recrystallized aluminum alloy products exhibiting a maximum R-value in the range of from about 40° to about 60° are generally indicative of products having a greater amount of brass texture, whereas recrystallized aluminum alloy products exhibiting an maximum R-value in the range of about 90° are indicative of products having a greater amount of Goss texture.

As noted above, texture intensities may be measured via x-ray diffraction and in accordance with "*Texture and Anisotropy, Preferred Orientations in Polycrystals and their Effect on Material Properties*", Kocks et al., pp. 140-141, Cambridge University Press (1998). However, the absolute intensity values of texture components measured may vary among institutes, due to hardware and/or software differences. Nonetheless, the relative ratios of the measured texture intensities may be used to determine the relative amounts of the two textures within the recrystallized alloy. Thus, in one embodiment, a recrystallized aluminum alloy comprises a recrystallized microstructure having a measured brass texture intensity of at least about 5. In one embodiment, the measured brass texture intensity is at least about 10. In other embodiments, the measured brass texture intensity is at least about 15, or at least about 20, or at least about 25, or at least about 30, or at least about 40, or at least about 50. The measured amount of Goss texture intensity is generally less than the measured amount of brass texture intensity. In one embodiment, recrystallized aluminum alloy comprises a recrystallized microstructure having a measured Goss texture intensity of less than about 20. In other embodiments, the measured Goss texture intensity is less than about 15, or less than about 10, or less than about 5. Thus, In one embodiment, the ratio of the amount of brass texture to the amount of Goss texture in a recrystallized aluminum alloy is at least about 1.25:1 (BTI:GTI). In other embodiments, the ratio of brass texture intensity to Goss texture intensity in a recrystallized aluminum alloy is at least about 1.5:1 (BTI:GTI), or at least about 2:1 (BTI:GTI), or at least about 3:1 (BTI:GTI), or at least about 4:1 (BTI:GTI), or at least about 5:1 (BTI:GTI), or at least about 6:1 (BTI:GTI), or at least about 7:1 (BTI:GTI), or at least about 8:1 (BTI:GTI), or at least about 9:1 (BTI:GTI), or at least about 10:1 (BTI:GTI). Irrespective of whether x-ray diffraction or OIM techniques are utilized, specimens analyzed in accordance with the present application include at least 1000 grains.

In one embodiment, the recrystallized aluminum alloy is a sheet product ("recrystallized sheet product"). As used herein, "sheet product" means rolled aluminum products having thicknesses of from about 0.01 inch (~0.25 mm) to about 0.5 inch (~12.7 mm). The thickness of the sheet may be from about 0.025 inch (~0.64 mm) to about 0.325 inch (~8.9 mm), or from about 0.05 inch (~1.3 mm) to about 0.325 inch (~8.3 mm). For many applications such as some aircraft fuselages, the sheet may be from about 0.05 inch (~1.3 mm) to about 0.25 inch (~6.4 mm) thick, or from about 0.05 inch (~1.3 mm) to about 0.2 inch (~5.1 mm) thick. The sheet may be unclad or clad, with cladding layer thicknesses of from about 1 to about 5 percent of the thickness of the sheet. The sheet product may comprise various aluminum alloy compositions. Some suitable alloy compositions include heat-treatable alloys, such as Al—Li based alloys, including one or more of the 2XXX series alloys defined by the Aluminum Association 2XXX series alloys, and variants thereof. One particularly useful alloy is a 2199 series alloy. In one embodiment, the aluminum alloy includes up to about 7.0 wt % copper. In one embodiment, the aluminum alloy includes up to about 4.0 wt % lithium. The recrystallized sheet products of the present disclosure may be utilized in a variety of industrial applications. For example, the recrystallized sheet products may be utilized in aerospace applications, such as in the production of a fuselage product (e.g., an aircraft fuselage section, or a fuselage sheet), or in transportation, automotive, or other industrial applications.

The recrystallized sheet products of the present disclosure generally exhibit higher tensile yield strengths and fracture toughness for a given thickness of the recrystallized sheet product. In one embodiment, a recrystallized sheet product has at least about the same fracture toughness and about the same tensile yield strength as a compositionally equivalent unrecrystallized alloy of the same product form and of similar thickness and temper. For example, the recrystallized sheet product may have a thickness of not greater than about 0.35 inch, a LT tensile yield strength of at least about 370 MPa, and T-L fracture toughness ($K_{app}$) of at least about 80 MPa($m^{1/2}$). As used herein, "LT tensile yield strength" means the LT tensile yield strength of a recrystallized sheet measured using ASTM B557M-06 (May 1, 2006). As used herein, "T-L fracture toughness" ($K_{app}$) means the T-L fracture toughness of the recrystallized sheet product measured using a 16 inch wide M(t) specimen with an initial crack length to width ratio of 2a/W=0.25 in accordance with ASTM B646-06a (Sep. 1, 2006).

Figure 2:
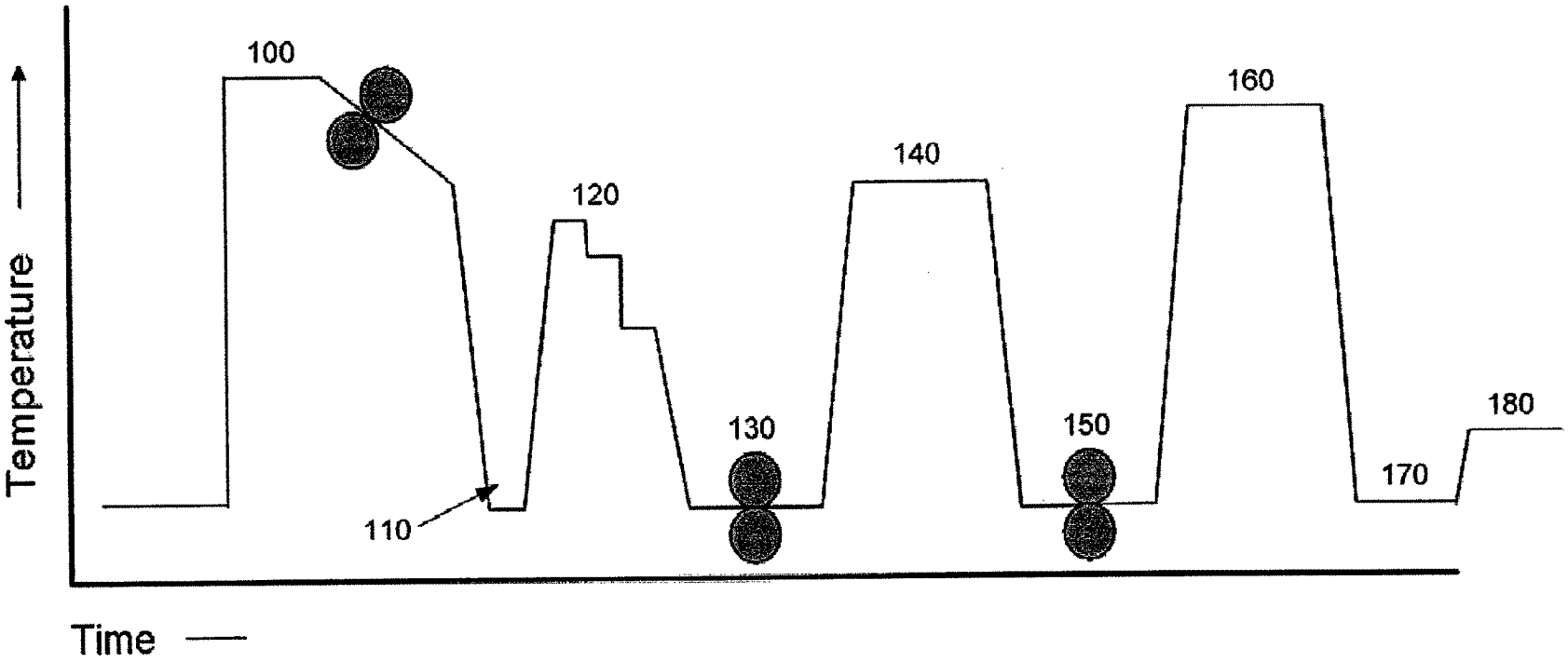
FIG. 2 Prior Art
FIG. 2 is a schematic view of a prior art process for producing an alloy sheet product.

The recrystallized sheet products of the present disclosure are generally produced by utilizing at least two recrystallization anneals, as opposed to conventional sheet production processes. One conventional process for producing a 2199 aluminum alloy recrystallized sheet product is illustrated in FIG. 2. In the illustrated embodiment, the conventional sheet production process includes a preheat step, a scalping step, and a hot rolling step (100), a cooling step (110), a recovery anneal (120), a cold work step (130), another recovery anneal (140), another cold work step (150), a solution heat treatment step (160) (i.e., a recrystallization anneal), a cooling step (170) and an aging step (180).

With respect to the conventional process illustrated in FIG. 2, the thermo-mechanical processes for conventional 2199 aluminum alloy recrystallized sheet products comprise alternating cold rolling and recovery annealing before recrystallization annealing (in this case in the form of a solution heat treatment). The recovery anneals may be used to soften materials between cold work passes, but are not designed to intentionally recrystallize materials prior to a subsequent cold rolling step. Thus, conventional sheet production processes generally only include a single recrystallization anneal, which occurs during the solution heat treatment step (160).

Figure 3:
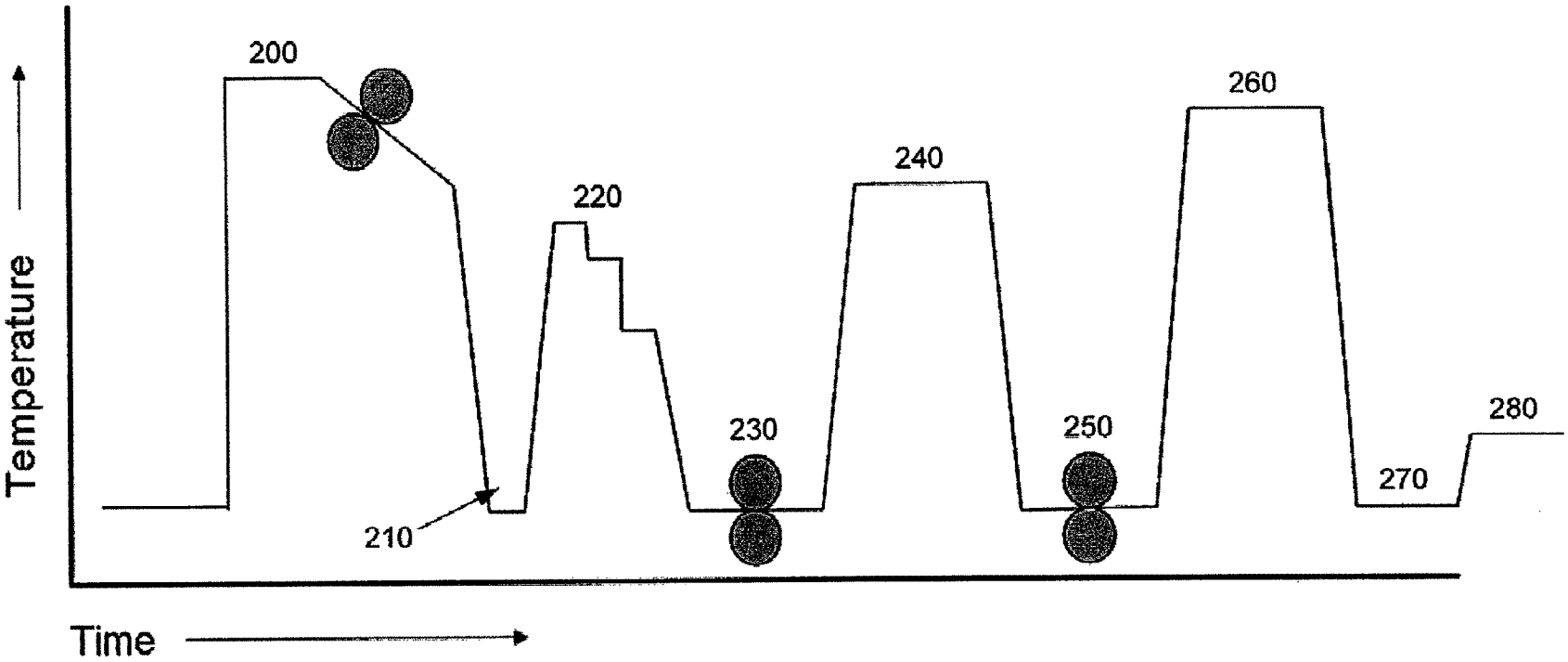
FIG. 3 is a schematic map illustrating one embodiment of a method for producing a recrystallized sheet product.

Conversely, the recrystallized sheet products of the present disclosure are generally produced via at least two recrystallization anneals. One embodiment of a recrystallized sheet production process is illustrated in FIG. 3. In the illustrated embodiment, the sheet production process includes a preheat step, a scalping step and a hot rolling step (200), a cooling step (210), a recovery anneal (220), a cold work step (230), a first recrystallization anneal (240), another cold work step (250), and a solution heat treatment step (260) (i.e., a second recrystallization anneal), a cooling step (270) and a conventional aging step (280). Thus, the present process includes at least one intermediate recrystallization anneal and one subsequent cold work pass prior to the final solution heat treating step (i.e., a second recrystallization anneal). The use of two recrystallization steps during formation of the sheet product may result in the production of recrystallized sheet products having the above-described brass texture and Goss texture characteristics (e.g., an amount of brass texture that exceeds an amount of Goss texture).

Various steps may be completed between the first (intermediate) recrystallization anneal and the final recrystallization anneal (i.e., the solution heat treatment step). For example, one or more of a recovery anneal and/or cold work step may be completed between the first and second recrystallization anneals. By way of illustration, and with reference to FIG. 4, a sheet production process may include a hot rolling step (310), a first cold work step (320), a first recrystallization anneal (330), a second cold work step (340), a first recovery anneal (350), a third cold work step (360) and a solution heat treating step (370) (i.e., a second recrystallization anneal).

Figure 5:
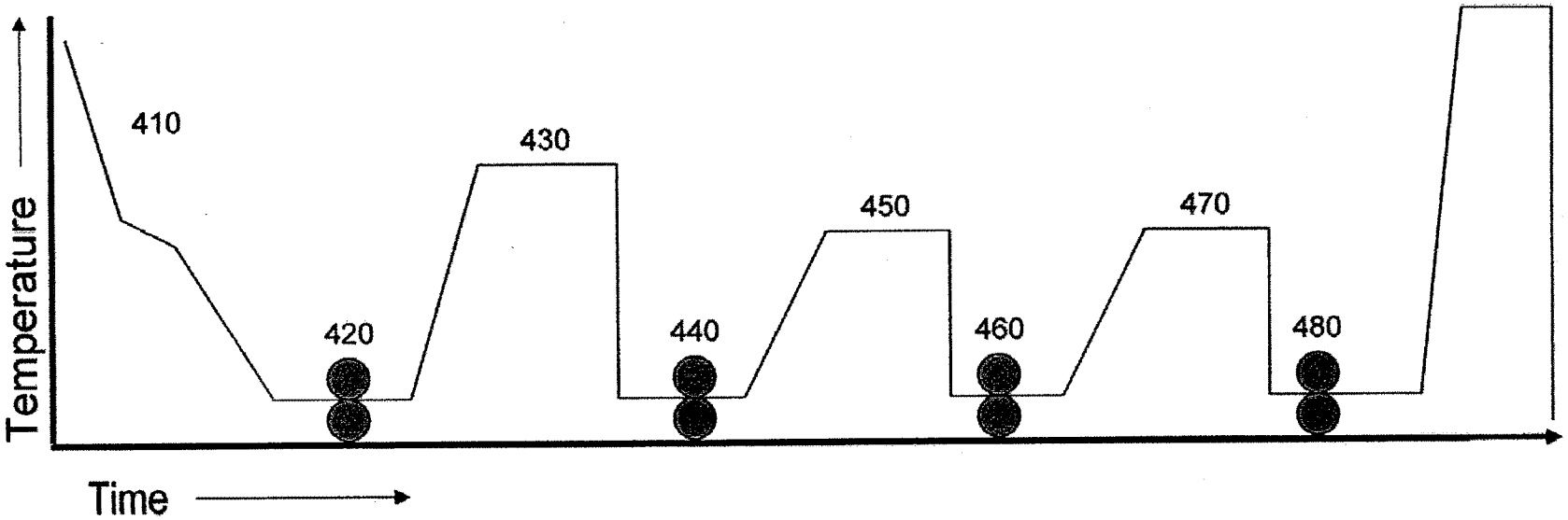
FIG. 5 is a schematic map illustrating one embodiment of a method for producing a recrystallized sheet product.

In another approach, and with reference to FIG. 5, a sheet production process may include a hot rolling step (410), a first cold work step (420), a first recrystallization anneal (430), a second cold work step (440), a first recovery anneal (450), a third cold work step (460), a second recovery anneal (470), a fourth cold work step (480) and a solution heat treating step (490) (i.e., a second recrystallization anneal). Other variations may also be completed. In one embodiment, only two recrystallization anneals are completed in the production of a recrystallized sheet product. In other embodiments, more than two recrystallization anneals are completed in the production of a recrystallized sheet product.

The processing conditions of the first and second recrystallization anneals may be substantially similar to one another, or the processing conditions of the first and second recrystallization anneals may be materially different from one another. For example, the first recrystallization anneal may include a heat-up period followed by soaking at temperatures that facilitate production of recrystallized grains within the alloy sheet (e.g., a first soaking temperature). The second anneal may include a heat-up period followed by soaking at temperatures that facilitate solution heat treatment of the alloy sheet (e.g., temperatures higher than the first soaking temperature). In one embodiment, a 2199 aluminum alloy may be processed by completing a first recrystallization anneal at temperature of about 454° C. for about 4 hours. After one or more other steps (e.g., cold work and/or recovery anneal steps), the 2199 alloy may be further processed by completing a second recrystallization anneal at a temperature of about 521° C. for about 1 hour.

Recrystallized sheet products of aluminum alloy series 2199 may have increased LT (long-transverse) tensile yield strength and/or T-L (transverse-long) fracture toughness. In one embodiment, a recrystallized sheet product may have an LT tensile yield strength of at least about 370 MPa, such as an LT tensile yield strength of at least about 380 MPa, or an LT tensile yield strength of at least about 390 MPa, or an LT tensile yield strength of at least about 400 MPa, or an LT tensile yield strength of at least about 410 MPa. In a related embodiment, a recrystallized sheet product may have T-L fracture toughness ($K_{app}$) of at least about 80 MPa($m^{1/2}$), such as a T-L fracture toughness of at least about 85 MPa($m^{1/2}$), or a T-L fracture toughness of at least about 90 MPa($m^{1/2}$), or a T-L fracture toughness of at least about 95 MPa($m^{1/2}$), or a T-L fracture toughness of at least about 100 MPa($m^{1/2}$), or a T-L fracture toughness of at least about 105 MPa($m^{1/2}$).

While the foregoing description predominately relates to sheet products, it is anticipated that the described methods may also be utilized with plate products, forged products, and extruded products. Plate products are distinguished from sheet products in that plate products have a thickness greater than that of sheet products (e.g., between about 0.5 inch an 12 inches).

EXAMPLES

Example 1

Two ingots of a 2199 aluminum alloy are direct chill (DC) cast. After stress relieving, the ingots are homogenized and scalped. The ingots are then heated to 950° F. and hot rolled into sheets having a thickness of 7.2 mm. These sheets are then recovery annealed by soaking at 371° C. for 4 hours, followed by soaking at 315° C. for 4 hours, followed by soaking at 204° C. for 4 hours. These sheets are further cold rolled with a 30% reduction in thickness. After the first cold rolling, a first sheet (Sheet 1) is subjected to a recrystallization anneal at 454° C. for 6 hours (after a 16 hour heat-up period) while a second sheet (Sheet 2) is subjected to a recovery anneal at 354° C. for 6 hours (after a 16 hour heat-up period). Subsequently, Sheet 1 and Sheet 2 are then both cold rolled to a final thickness of 3.5 mm. After cold rolling, both Sheet 1 and Sheet 2 are solution heat treated at about 521° C. for 1 hour and quenched in water at room temperature. Sheet 1 and Sheet 2 are then both tempered to a T8 temper using the same tempering conditions.

The grains and textures of Sheet 1 and Sheet 2 are measured after the final aging practice. Test samples of these sheets are prepared by polishing with Buehler Si—C paper by hand for 3 minutes, followed by polishing by hand with a Buehler diamond liquid polish having an average particle size of about 3 μm. The samples are anodized in an aqueous fluoric-boric solution for 30-45 seconds. The microstructures are obtained with a polarized beam via a Zeiss optical microscope at a magnification of from about 150× to about 200×.

Figure 6A:
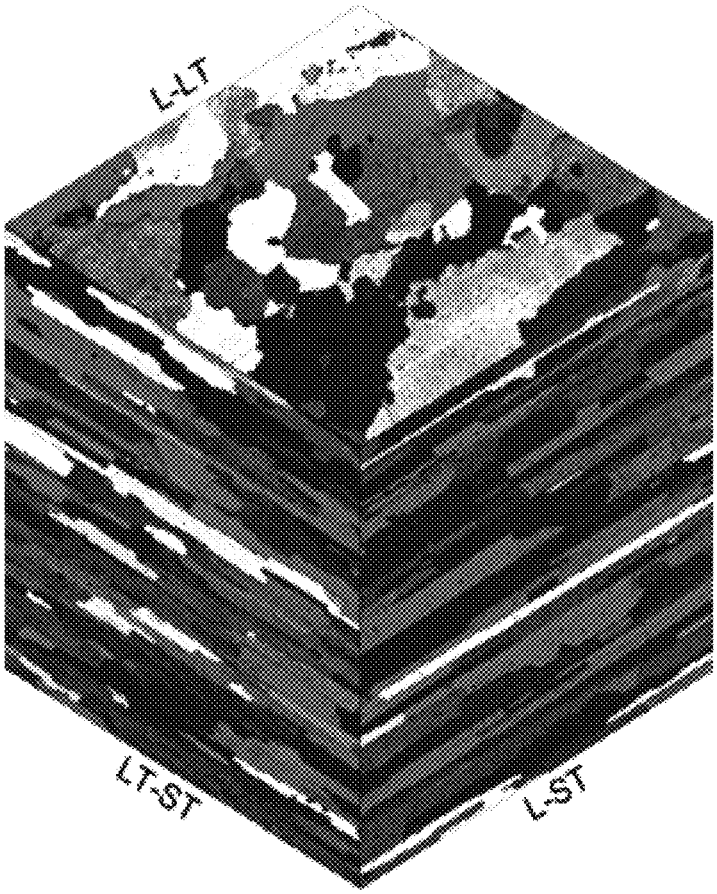
FIGS. 6*a* and 6*b* are photomicrographs illustrating a microstructure of a sheet product produced in accordance with an embodiment of the present disclosure.
Figure 6B:
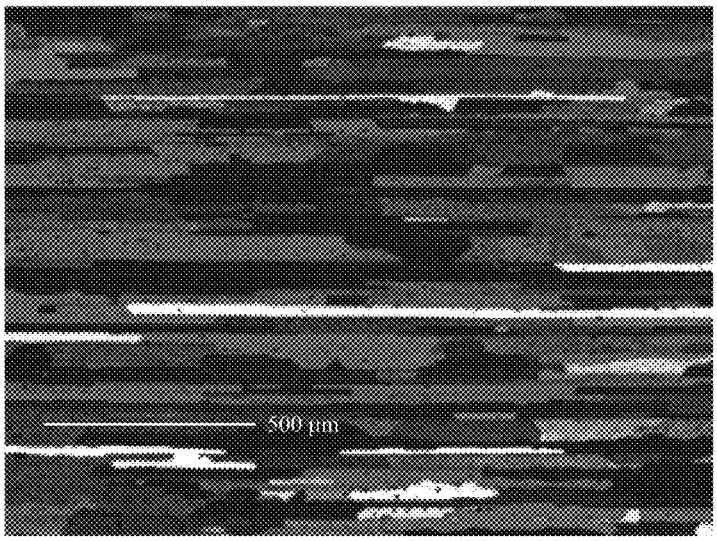
Figure 7A:
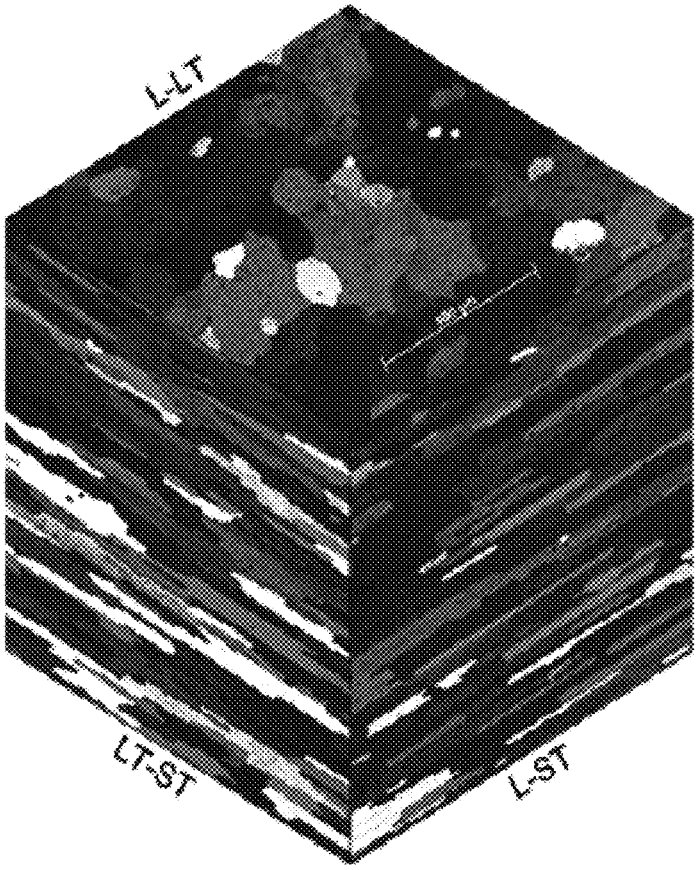
FIGS. 7*a* and 7*b* are photomicrographs illustrating a microstructure of a conventionally processed sheet product.
Figure 7B:
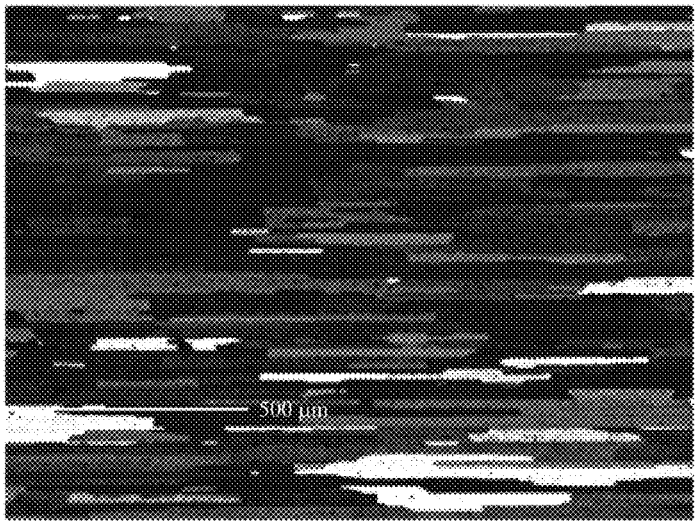

The crystallographic textures of the samples of Sheet 1 and Sheet 2 are determined using the "texture intensity measurement procedure", described above, but using internally developed software internally developed software. FIG. 6*a* illustrates a microstructure of Sheet 1 after solution heat treatment. The microstructure is fully recrystallized. FIG. 6*b* illustrates a microstructure of Sheet 1 taken at transverse direction (LT-ST), and illustrates a fully recrystallized and pancake shaped microstructure. FIG. 7*a* illustrates a microstructure of Sheet 2 after solution heat treatment. FIG. 7*b* illustrates a microstructure of Sheet 2 taken at transverse direction (LT-ST), and illustrates a fully recrystallized and pancake shaped microstructure. As illustrated in FIGS. 6*a*, 6*b* and 7*a*, 7*b*, there is no noticeable difference in grain size between Sheet 1, which was processed with two recrystallization anneals, and Sheet 2, which was processed with a single recrystallization anneal.

The samples of Sheet 1 and Sheet 2 are analyzed with OIM. The OIM sample procedure, described above, is used to determine the area fraction of Goss oriented grains and brass oriented grains for both sheets. FIG. 8 illustrates the OIM scanned image of Sheet 1. In Sheet 1, the area fraction of brass grains is greater than 10%, while the area fraction of brass oriented is less than 3%. FIG. 9. illustrates the OIM scanned image of conventionally processed sample 2. In Sheet 2, the area fraction of Goss grains is greater than 25%, while the area fraction of brass oriented is less than 1%.

Figure 10:
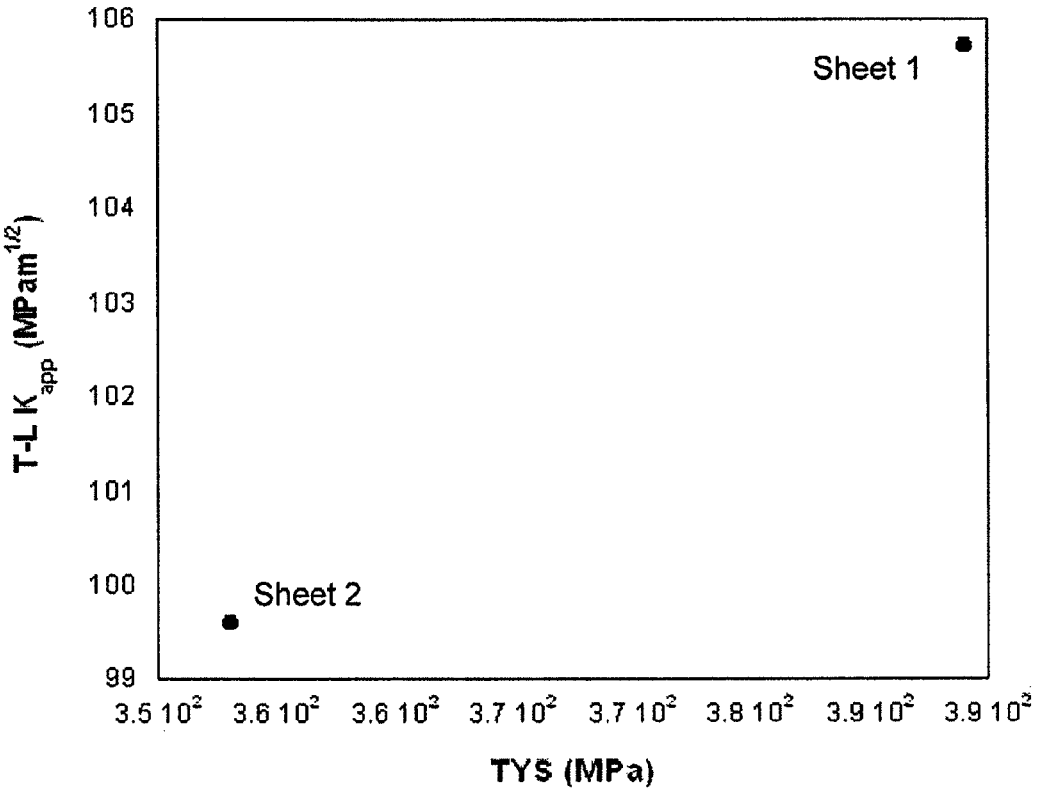
FIG. 10 is a graph illustrating the fracture toughness and tensile yield strength properties for a sheet product produced in accordance with an embodiment of the present disclosure and a conventionally produced sheet product.

Fracture toughness tests are performed on the sheets using a 16 wide M(t) specimen with an initial crack length to width ratio 2a/W=0.25 in accordance with ASTM B646-06a. Tensile testing is conducted in the LT direction in accordance with ASTM B557M-06 (May 1, 2006) and the tensile results reported are the average of duplicate tests. As illustrated in FIG. 10, Sheet 1 exhibits improved properties in combination of long transverse (T-L) $K_{app}$ fracture toughness and tensile yield strength (TYS) as compared to the properties of Sheet 2.

Table 1, below, contains summary data relating to the properties of Sheet 1 and Sheet 2. Sheet 1, which is manufactured with two recrystallization anneals, has a brass texture intensity nearly 9 times greater than its Goss texture intensity (29.8 for brass texture intensity, as opposed to 3.4 for Goss texture intensity). Conversely, Sheet 2, which is manufactured with the conventional, single recrystallization anneal (i.e., the solution heat treatment step) has a Goss texture intensity that was about 27 times greater than its brass texture intensity (35.7 for Goss texture intensity, as opposed to 1.3 for brass texture intensity). Hence, utilizing two recrystallization anneals during processing of alloy sheets may result in production of recrystallized alloy sheets having an amount of brass texture that exceeds the amount of Goss texture.

TABLE 1

| | Sheet 1 | Sheet 2 |
|---|---|---|
| Process | Two recrystallization anneal steps | Single recrystallization anneal step |
| Final Thickness | 3.5 mm | 3.5 mm |
| Texture after solution heat treatment (SHT) | Measured Intensity | Measured Intensity |
| brass texture | 29.8 | 1.3 |
| Goss texture | 3.4 | 35.7 |
| {112}<111> Copper texture | 1.1 | 2 |
| S1 texture | 2.4 | 3.5 |
| Cube texture | 0.8 | 1.8 |
| Area fraction of brass texture via OIM | 11.3% | 0.7% |
| Area fraction of Goss texture via OIM | 2.4% | 26.3% |
| LT TYS (MPa) | 389 | 358 |
| LT UTS (MPa) | 466 | 454 |
| T-L $K_c$ (MPa√m) | 148.36 | 136.02 |
| T-L $K_{app}$ (MPa√m) | 105.73 | 99.6 |
| Grain Structure after SHT | Recrystallized | Recrystallized |

Example 2

Figure 11:
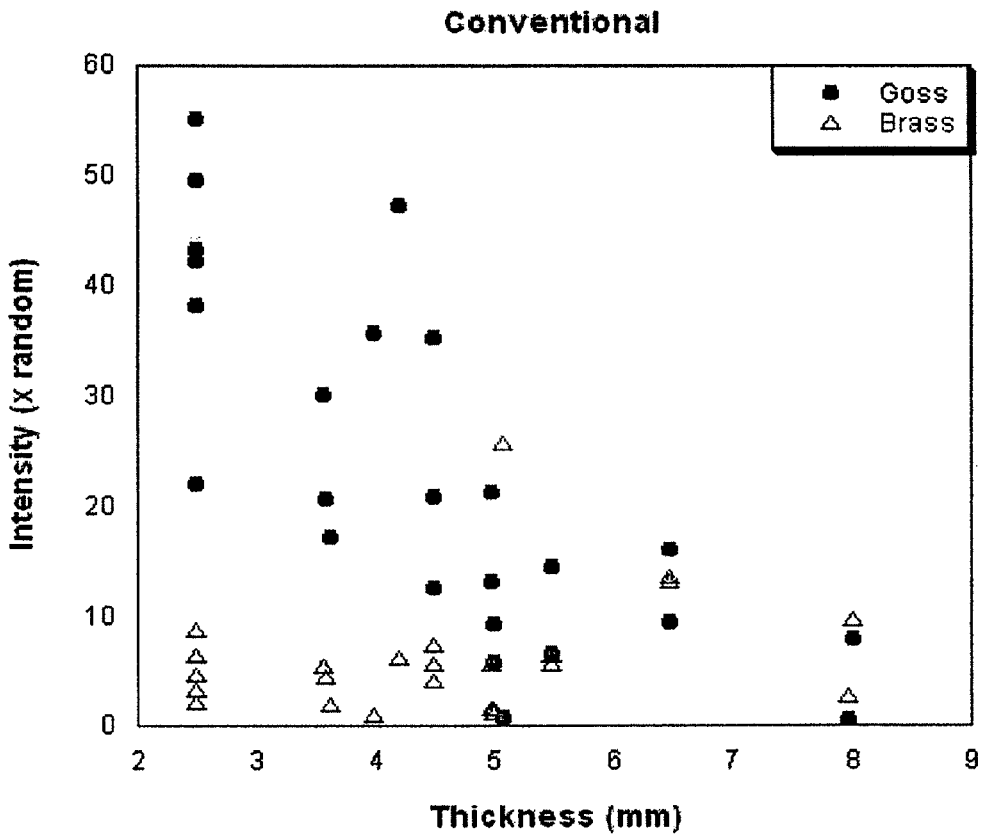
FIG. 11 is a graph illustrating Goss texture intensity and brass texture intensity as a function of thickness for various conventionally produced sheet products.
Figure 12:
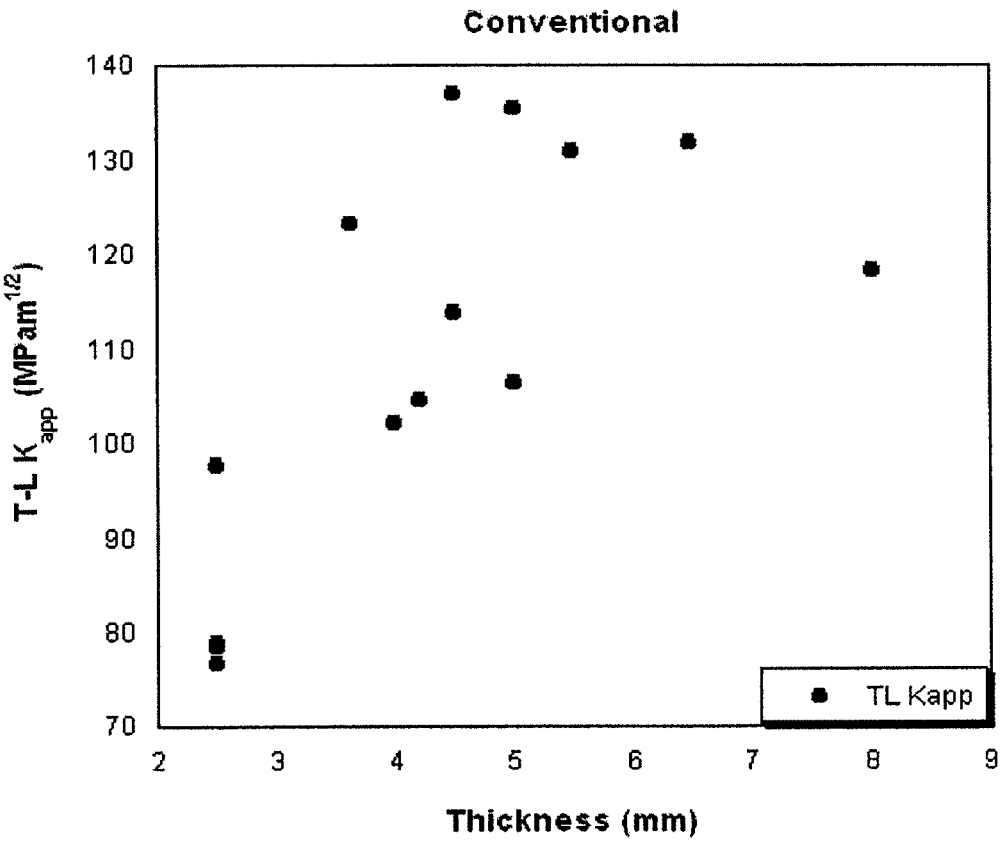
FIG. 12 is a graph illustrating toughness as a function of thickness for various conventionally produced sheet products.
Figure 13:
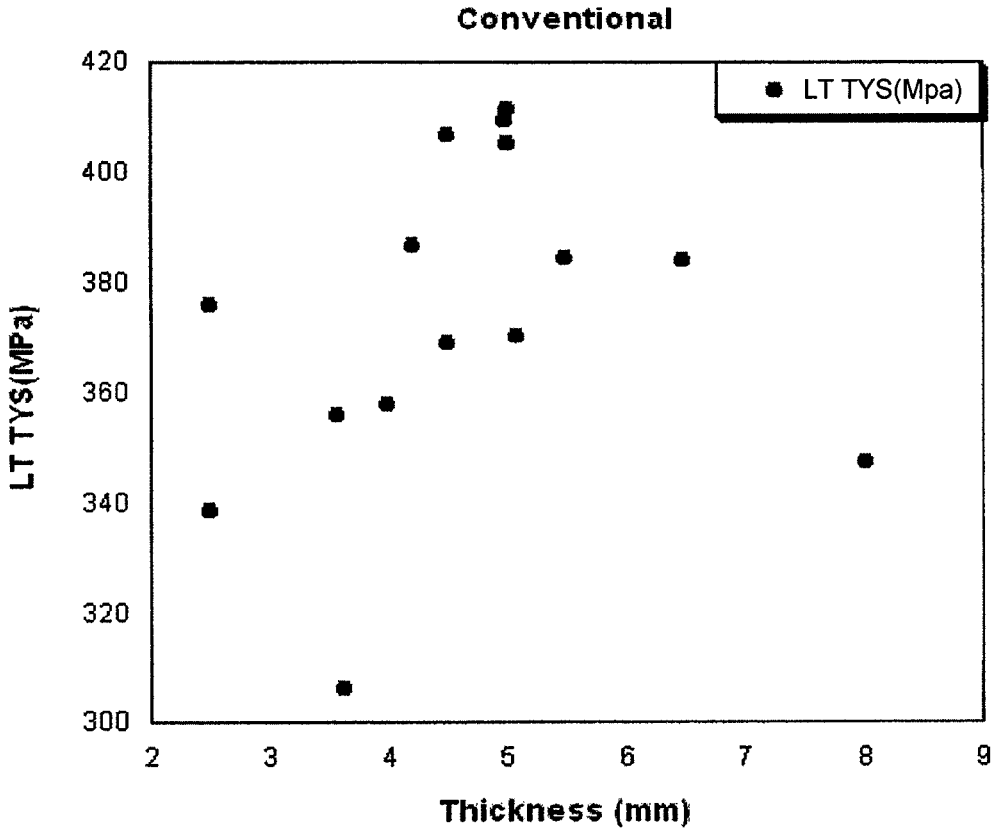
FIG. 13 is a graph illustrating strength as a function of thickness for various conventionally produced sheet products.

Various plant produced 2199 alloy recrystallized sheets (i.e., fabricated with a conventional, single recrystallization anneal process) are subjected to a variety of tests. For example, test samples are prepared as described above and both brass texture intensity and Goss texture intensity are measured as a function of gauge thickness of the sheet product. FIG. 11 illustrates brass texture intensity and Goss texture intensity as a function of gauge thickness for the conventional 2199 sheets. A noticeable trend is that the Goss intensity increases, but the brass intensity decreases as the gauge thickness gets thinner. Toughness and strength tests are also performed on the conventional sheet products. The sheets are subjected to tensile testing in the LT direction in accordance with ASTM B557M-06 (May 1, 2006) and T-L fracture toughness testing using a 16 in. wide M(t) specimen with an initial crack length to width ratio 2a/W=0.25 in accordance with ASTM B646-06a. The reported tensile results are the average of duplicate tests. FIG. 12 and FIG. 13 illustrate the corresponding T-L fracture toughness ($K_{app}$) and ultimate tensile strength, respectively, as a function of gauge thickness. Reduction in both toughness and strength is observed with decreasing gauge thickness, especially for sheets having a thickness below about 4 mm.

Example 3

Figure 14:
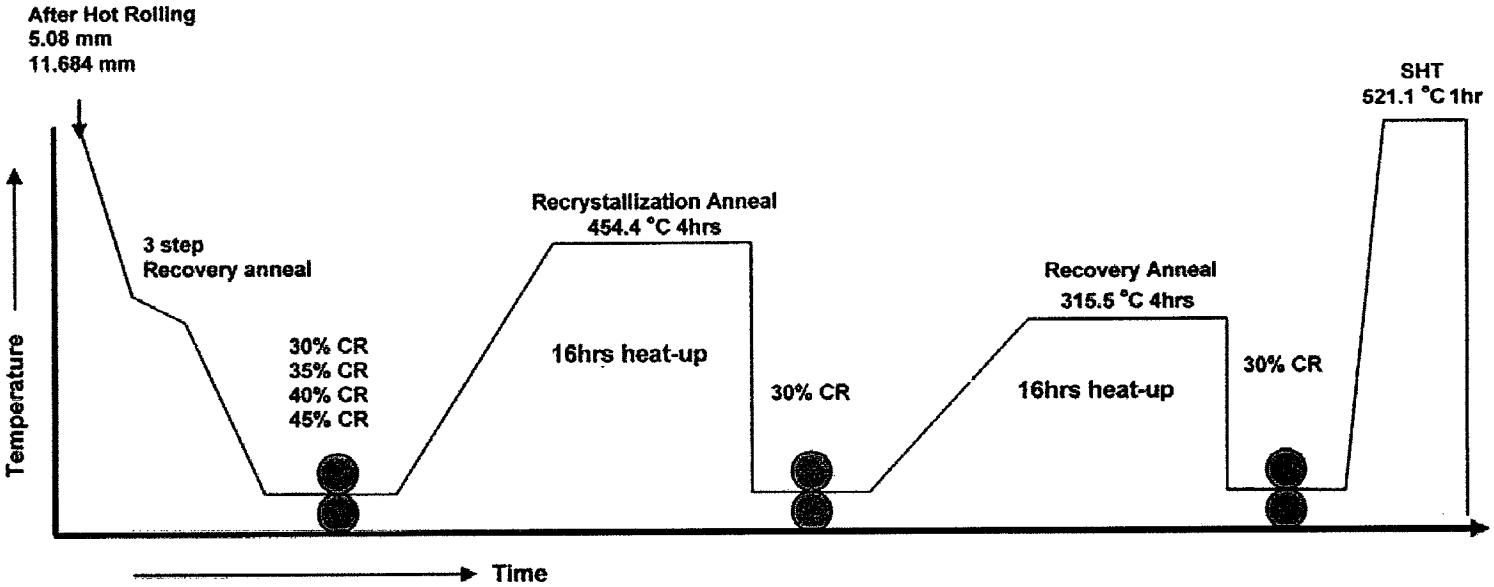
FIG. 14 is a schematic map illustrating one embodiment of a method for producing a recrystallized sheet product.
Figure 15:
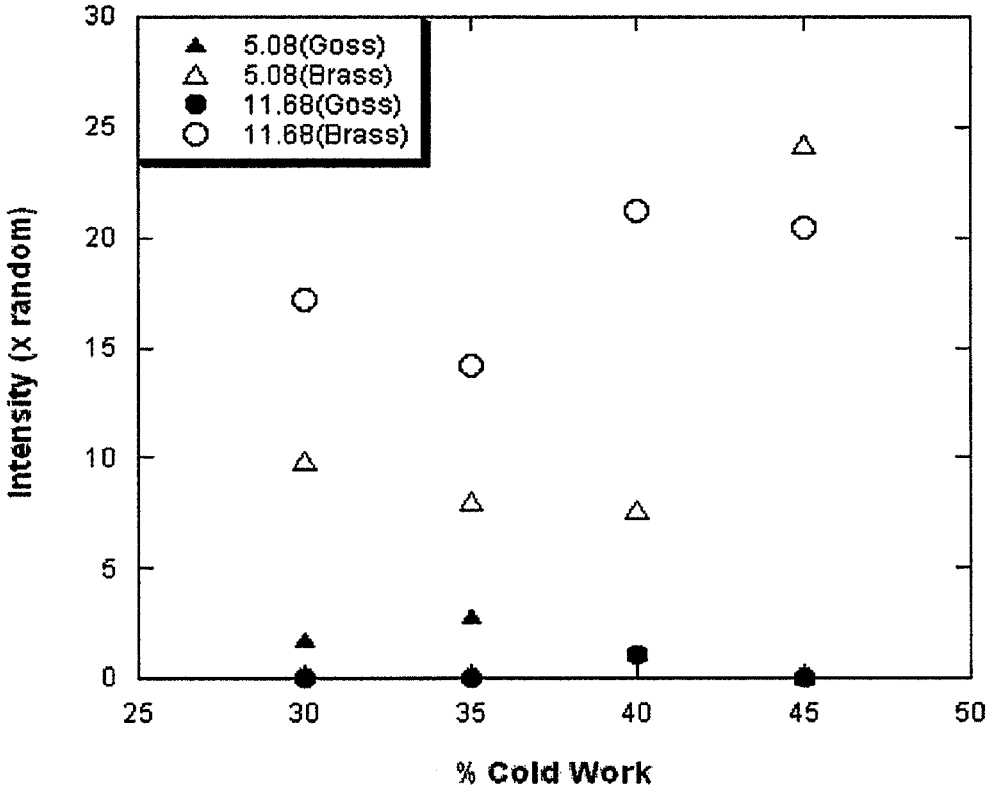
FIG. 15 is a graph illustrating Goss texture intensity and brass texture intensity as a function of thickness for sheet products produced in accordance with embodiments of the present disclosure.

A 2199 alloy DC cast ingot having a size of 381 mm×1270 mm×4572 mm (thickness×width×length) is scaled and homogenized. The ingots are then hot rolled to two different thickness, 5.08 mm and 11.68 mm, and recovery annealed via a 3-step recovery anneal process, which includes 4 hours of soaking at 371° C., 4 hours of soaking at 315° C., and 4 hours of soaking at 204° C. After this 3-step recovery anneal, coupons having a size of 50.8 mm×254 mm (width×length) from the hot rolled and annealed plates are produced. As illustrated in FIG. 14, after the 3-step recovery anneal, a coupon of each thickness (i.e., one 5.08 mm coupon and one 11.68 mm coupon) is cold roll reduced by one of 30%, 35%, 40% and 45%, thus producing eight coupons with varying cold work amounts and thicknesses. Each of these eight coupons is then processed via a recrystallization anneal at about 454° C. at 4 hours, with a 16 hour heat-up period. Each of the eight coupons is then cold roll reduced an additional 30%, and then subjected to a recovery anneal at about 315° C. and 4 hours, with a 16 hour heat-up period. Each of the eight coupons is then cold roll reduced an additional 30% and then solution heat treated at about 521° C. for 1 hour. After the solution heat treatment, test samples are prepared as described above and the microstructure of each sample is measured. FIG. 15 shows the intensities of the Goss texture and brass texture as a function of hot rolled thickness and amount of cold work. The results indicate that the two-step recrystallization process results in sheets having a higher amount of brass texture than Goss texture in all 8 coupons, thereby indicating that various amounts of cold work and various thicknesses can be utilized with the two-step recrystallization process.

Example 4

Figure 16:
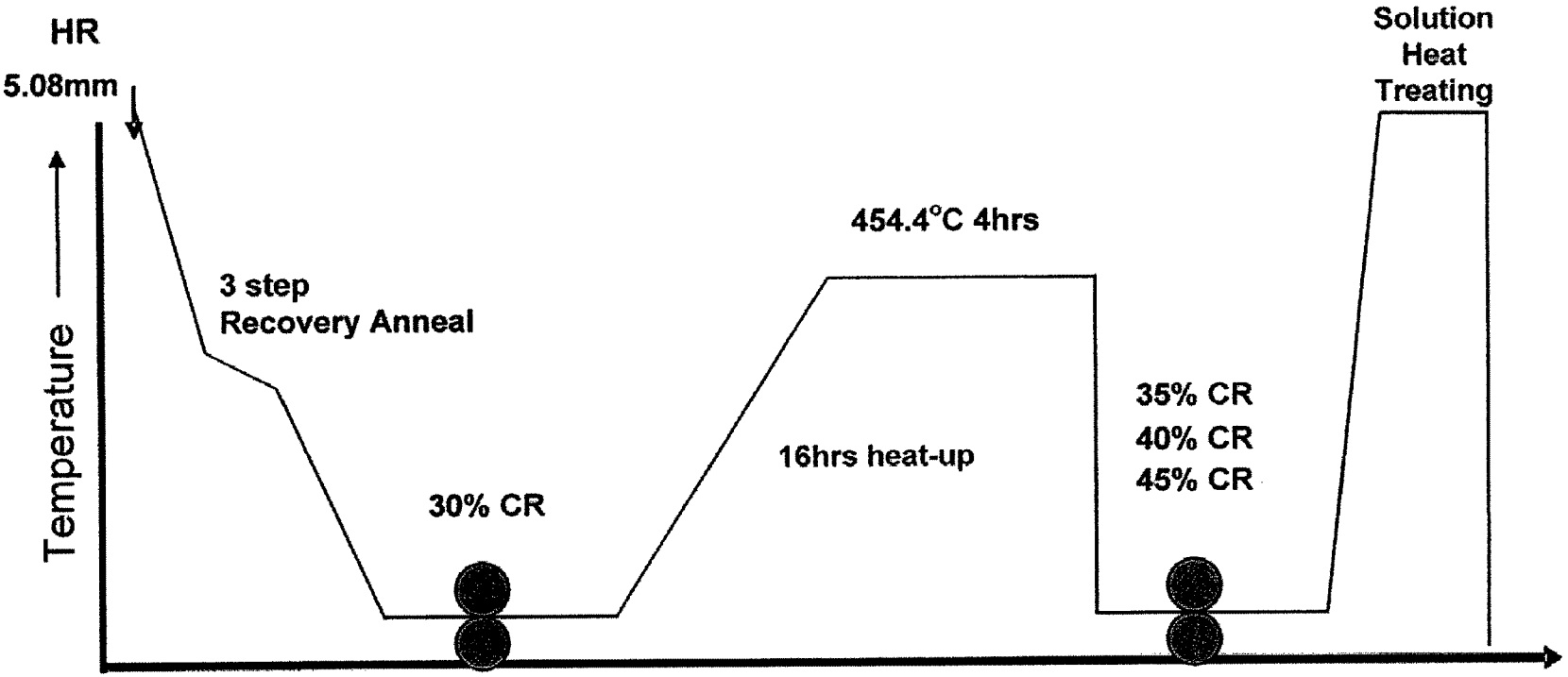
FIG. 16 is a schematic map illustrating another embodiment of a method for producing a recrystallized sheet product.

With reference to FIG. 16, a 2199 alloy is hot rolled to a thickness 5.08 mm and recovery annealed via a 3-step recovery anneal process, which includes 4 hours of soaking at 371° C., 4 hours of soaking at 315° C., and 4 hours of soaking at 204° C. After this 3-step recovery anneal, coupons from the hot rolled and annealed plates are produced. Each of the coupons is cold roll reduced 30%. Each of these eight coupons is then processed via a recrystallization anneal at about 454° C. for 4 hours, with a 16 hour heat-up period. The coupons are then separately cold roll reduced an additional 35%, 40%, and 45% respectively. The coupons are then solution heat treated at about 521° C. for 1 hour. After the solution heat treatment, test samples are prepared as described above and the microstructure of each sample is measured. The microstructure is fully recrystallized.

Figure 4:
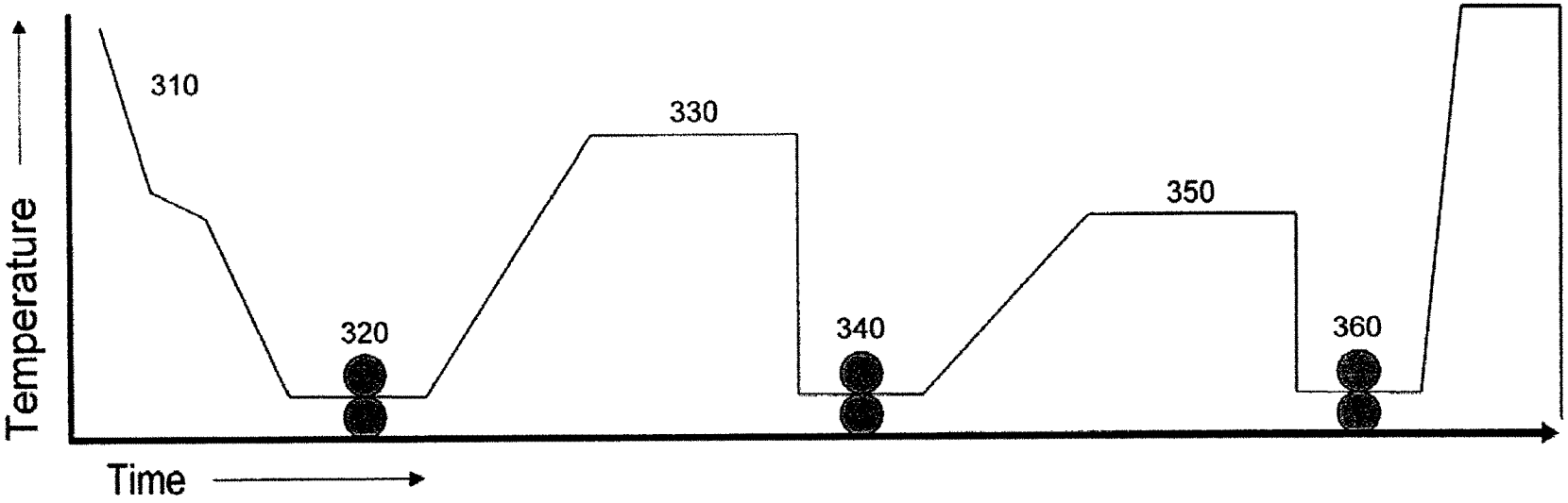
FIG. 4 is a schematic map illustrating one embodiment of a method for producing a recrystallized sheet product.

Another 5.08 mm thick coupon is produced via an initial hot rolling and 3-step recovery anneal process, as described above, and is then processed in accordance with the fabrication map illustrated in FIG. 4. In particular, after the initial cold work, the coupon is processed via a recrystallization anneal at about 454° C. for 4 hours, with a 16 hour heat-up period. The coupon is then cold roll reduced an additional 30%. The coupon is then processed via a recovery anneal at about 315° C. for 4 hours, with a 16 hour heat-up period. The coupon is then cold roll reduced an additional 30%. The coupon is then solution heat treated at about 521° C. for 1 hour.

Another 5.08 mm thick coupon is produced via an initial hot rolling and 3-step recovery anneal process, as described above, and is then processed in accordance with the fabrication map illustrated in FIG. 5. In particular, after the initial cold work, the coupon is processed via a recrystallization anneal at about 454° C. for 4 hours, with a 16 hour heat-up period. The coupon is then cold roll reduced an additional 30%. The coupon is then processed via a recovery anneal at about 315° C. for 4 hours, with a 16 hour heat-up period. The coupon is then cold roll reduced an additional 30%. The coupon is then processed via another recovery anneal at about 315° C. for 4 hours, with a 16 hour heat-up period. The coupon is then cold roll reduced an additional 30%. The coupon is then solution heat treated at about 521° C. for 1 hour.

Figure 17:
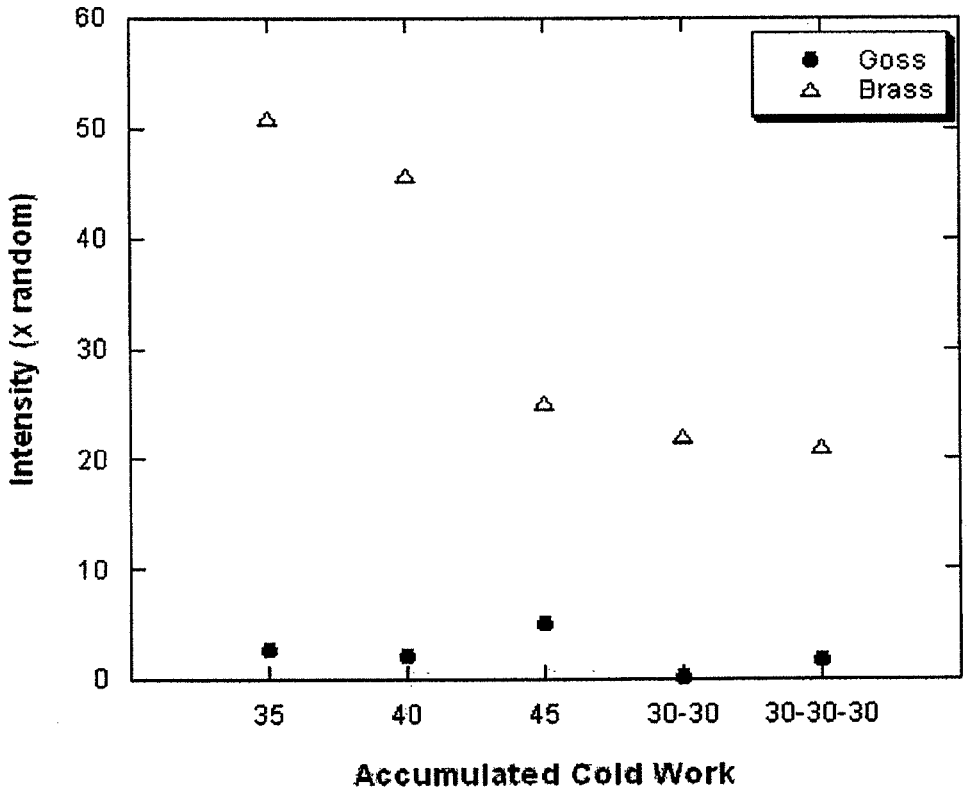
FIG. 17 is a graph illustrating brass texture intensity and Goss texture intensity as a function of accumulated cold work for sheet products produced in accordance with embodiments of the present disclosure.

Test samples are prepared as described above and the microstructure of each sample is measured. FIG. 17 illustrates the texture intensities as a function of accumulated cold work from at least some of the above coupons. These, and other results, indicate that the strength of sheets having recrystallized brass texture in accordance with the present disclosure can be controlled by adjusting the amount of cold work after the first intermediate recrystallization anneal.

Furthermore, these and other results illustrate that the brass texture in recrystallized Al—Li sheets is attainable by applying intermediate recrystallization anneals and recrystallization during solution heat treatment. In addition, the strength of the brass texture in recrystallized sheets can be controlled by optimizing the thermomechanical process parameters comprising hot rolling, cold rolling and annealing.

Example 5

Figure 18:
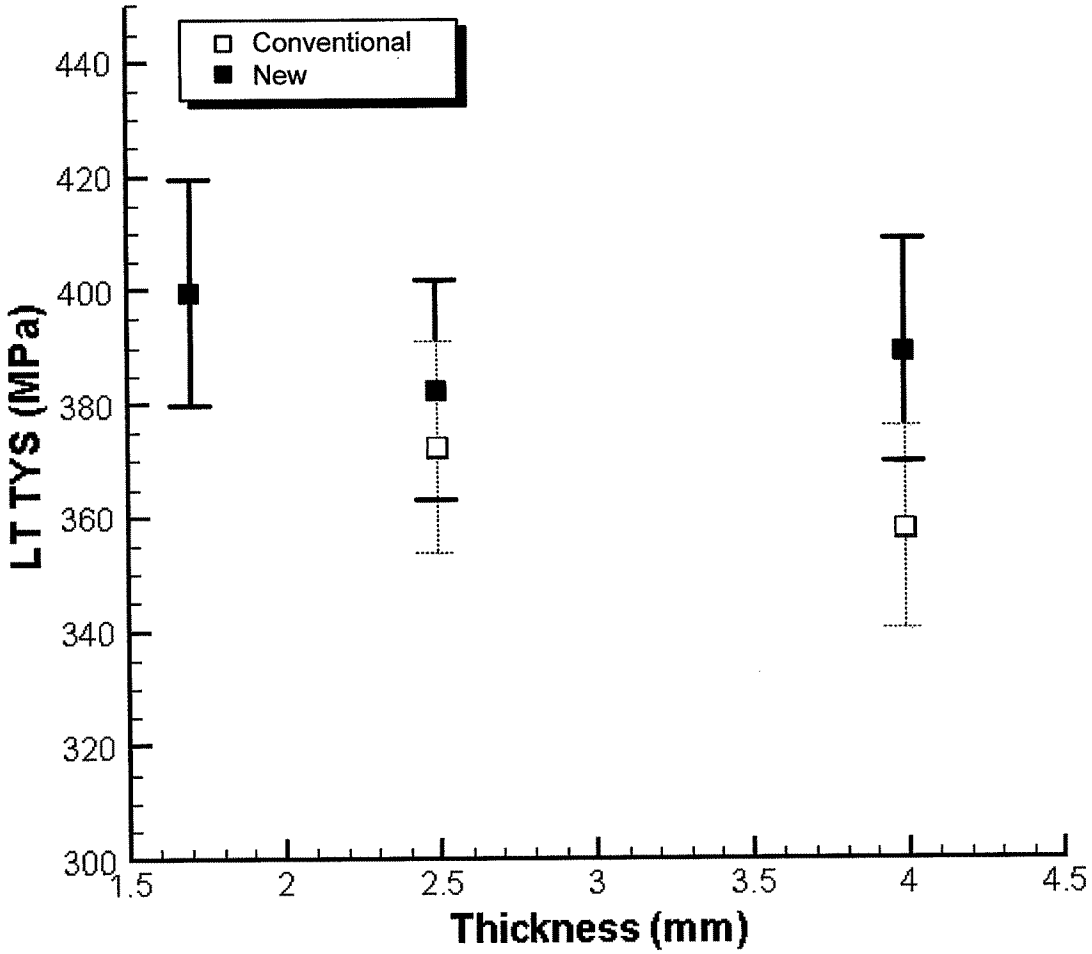
FIG. 18 is a graph illustrating toughness as a function of thickness for conventionally produced sheet products and sheet products produced in accordance with embodiments of the present disclosure.
Figure 19:
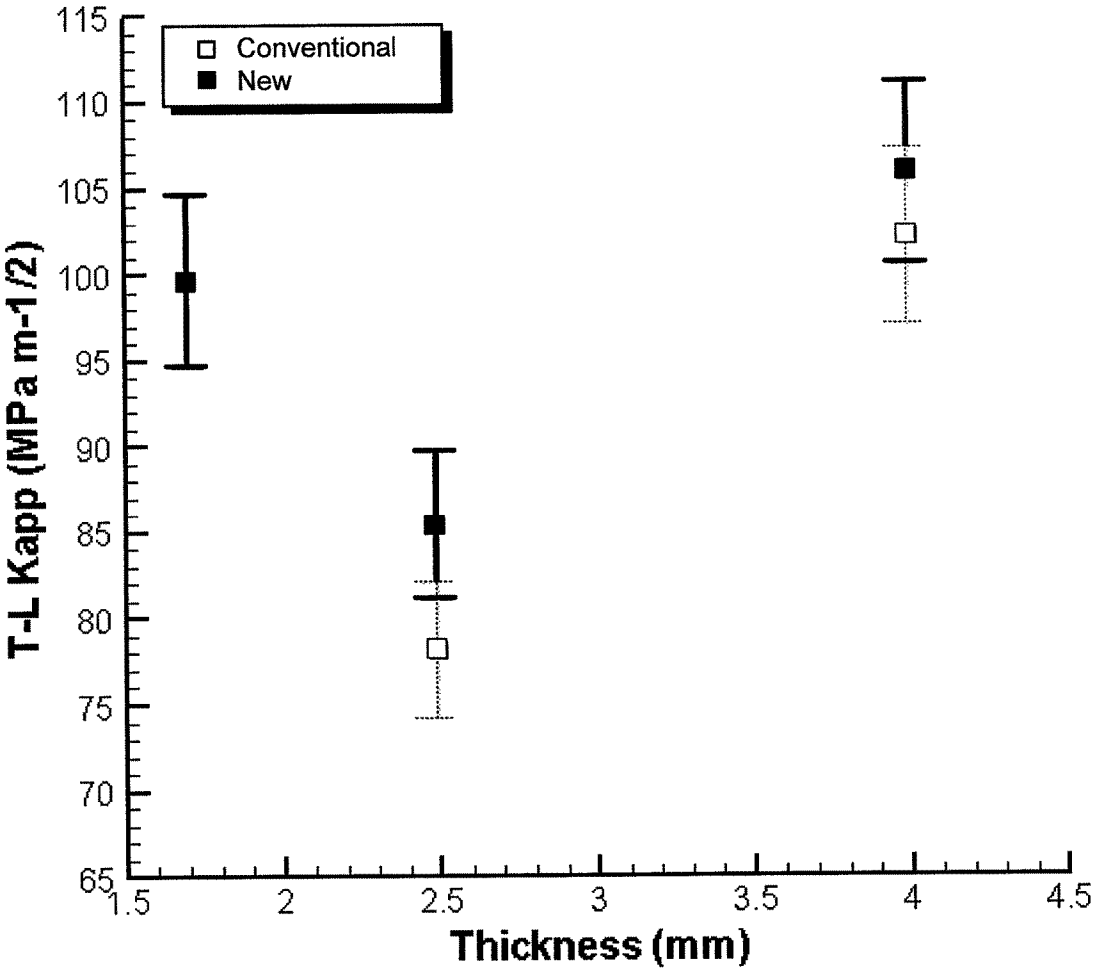
FIG. 19 is a graph illustrating strength as a function of thickness for conventionally produced sheet products and sheet products produced in accordance with embodiments of the present disclosure.
Figure 20:
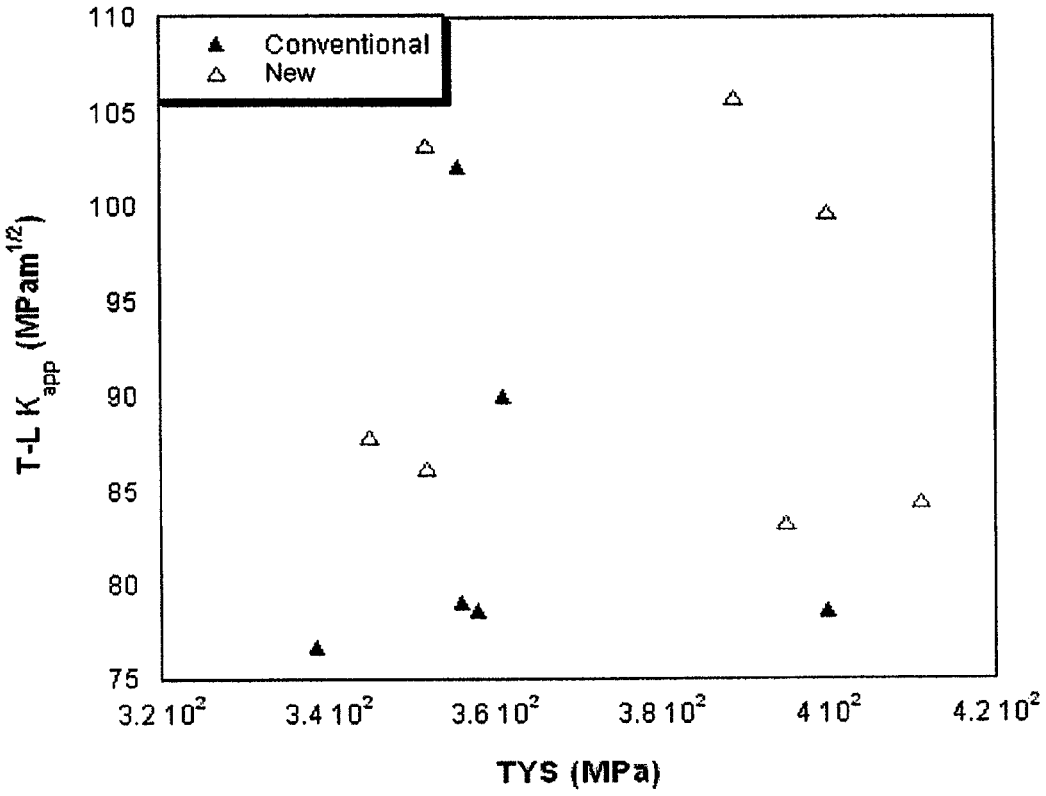
FIG. 20 is a graph illustrating strength as a function of toughness for conventionally produced sheet products and sheet products produced in accordance with embodiments of the present disclosure.

Various ones of the samples produced in Examples 3 and 4 are selected for mechanical testing. Since aging is a key process to affect the final properties, the aging is done at the same T8 condition for both the conventionally processed materials and materials processed via a dual recrystallization process. The sheets are subjected to tensile testing in the LT direction in accordance with ASTM B557M-06 (May 1, 2006) and T-L fracture toughness testing using a 16 in. wide M(t) specimen with an initial crack length to width ratio 2a/W=0.25 in accordance with ASTM B646-06a. The reported tensile results are the average of duplicate tests. FIG. 18 illustrates the average T-L fracture toughness ($K_{app}$) values of the conventionally processed recrystallized sheets and the recrystallized sheet products of the present disclosure as a function of gauge thickness. FIG. 19 illustrates the average LT tensile yield strength of the conventionally processed recrystallized sheets and the recrystallized sheet products of the present disclosure as a function of gauge thickness. As shown in FIGS. 18 and 19, increasing the amount of brass texture and consequently reducing the amount of Goss texture in 2199 recrystallized sheets generally results in sheet products having an improved LT strength and T-L toughness combination relative to conventionally processed sheets. FIG. 20 illustrates a strength and toughness plot using the data illustrated in FIGS. 16 and 17.

Figure 21:
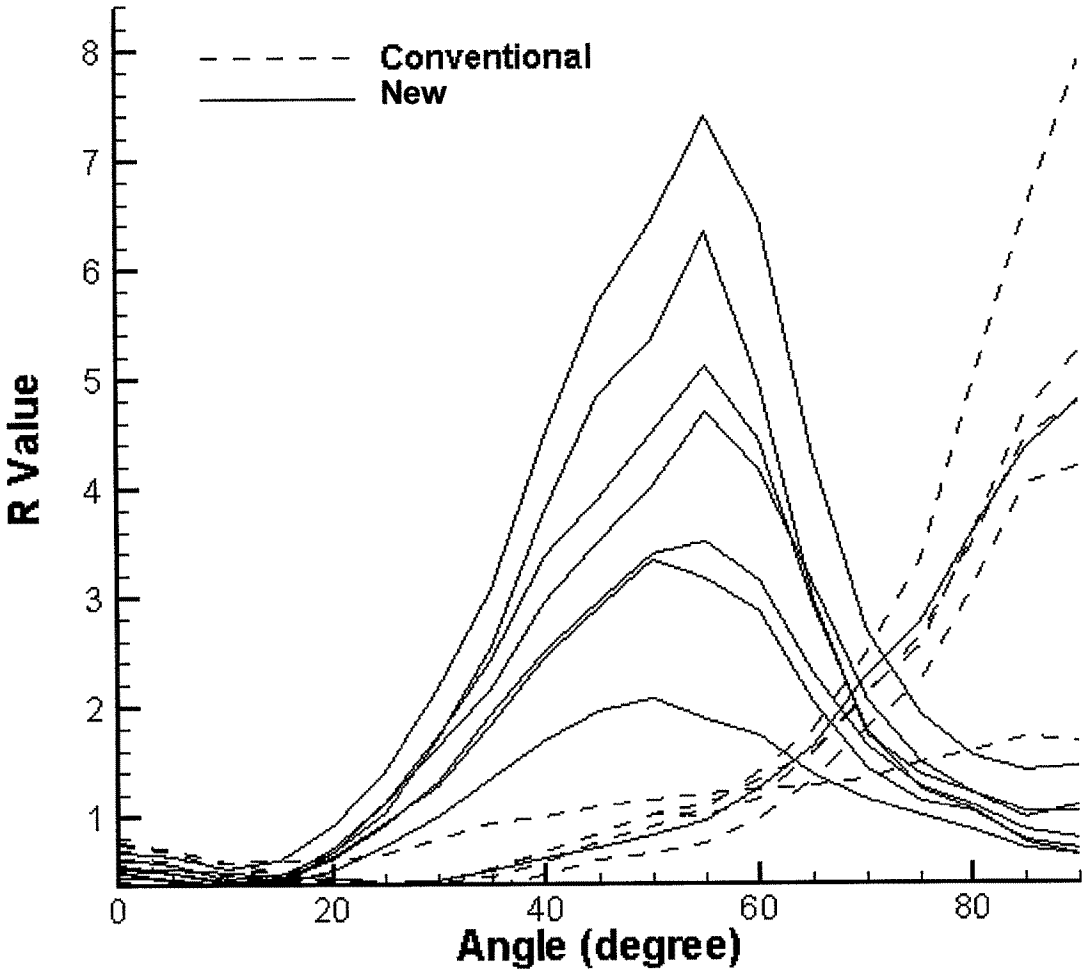
FIG. 21 is a graph illustrating R-values as a function of in-plane rotation angle from the L direction for sheets manufactured in accordance with embodiments of the present disclosure invention and for conventionally manufactured sheets.

FIG. 21 shows R-values of samples produced in accordance with methods of the present disclosure and the R-values of conventionally produced samples. The estimated R-values are obtained as a function of rotation angle from Angle=0° (where the L direction is parallel to the tension direction) to Angle=90° (where the L direction is perpendicular to the tension direction). The variation in R-values as a function of rotation angle is a direct result of anisotropy in mechanical behavior due to crystallographic texture. As shown in FIG. 21, samples produced in accordance with the present disclosure exhibit maximum R-values between 40° and 60°, which is a classical R-value distribution of a Brass textured sheet, while the conventionally processed samples exhibit maximum R-values of 90°, which is a classical R-value distribution of a Goss textured sheet.

While various embodiments of the present invention have been described in detail, it is apparent that modifications and adaptations of those embodiments will occur to those skilled in the art. However, it is to be expressly understood that such modifications and adaptations are within the spirit and scope of the present invention.

What is claimed is:

1. An aluminum alloy product comprising:

a 2xxx aluminum alloy;

(a) wherein the aluminum alloy is recrystallized and comprises at least 60% recrystallized grains;

(b) wherein at least some of the recrystallized grains have a texture, and wherein at least some of these recrystallized grains have a brass texture;

(c) wherein the recrystallized grains having the brass texture comprise the largest fraction of the recrystallized grains having texture;

(d) wherein an area fraction of the brass texture is at least 10%; and (e) wherein the 2xxx series aluminum alloy product exhibits a tensile yield strength and fracture toughness combination that is least equivalent to a compositionally equivalent unrecrystallized alloy product of the same product form and of similar thickness and temper.

2. The aluminum alloy product of claim 1, wherein at least some of the recrystallized grains have a Goss texture, and wherein the aluminum alloy product comprises an area fraction of Goss texture.

3. The aluminum alloy product of claim 2, wherein a ratio of the area fraction of brass texture to the area fraction of Goss texture is at least 1.5:1.

4. The aluminum alloy product of claim 2, wherein a ratio of the area fraction of brass texture to the area fraction of Goss texture is at least 1.75:1.

5. The aluminum alloy product of claim 2, wherein a ratio of the area fraction of brass texture to the area fraction of Goss texture is at least 2:1.

6. The aluminum alloy product of claim 1, wherein the aluminum alloy product comprises up to 7.0 wt % copper.

7. The aluminum alloy product of claim 6, wherein the aluminum alloy product comprises up to 4.0 wt % lithium.

8. The aluminum alloy product of claim 1, wherein the 2xxx aluminum alloy is 2199.

9. The aluminum alloy product of claim 1, wherein the aluminum alloy product is in the form of a sheet.

10. The aluminum alloy product of claim 9, wherein the sheet has a thickness of not greater than 0.35 inch, a LT tensile yield strength of at least 370 MPa and a T-L fracture toughness ($K_{app}$) of at least 80 MPa(m½).

11. The aluminum alloy product of claim 1, wherein the aluminum alloy product has a peak R-value in the range of from 40° to 60°.

12. A recrystallized aluminum alloy sheet product, wherein the aluminum alloy is a 2199 series alloy, wherein the recrystallized aluminum alloy sheet product has recrystallized grains having brass texture and Goss texture, wherein the amount of brass texture exceeds the amount of Goss texture, (a) wherein the recrystallized grains having the brass texture comprise the largest fraction of the recrystallized grains having texture;

(b) wherein an area fraction of the brass texture is at least 10%; and (c) wherein the sheet product has a thickness of not greater than 0.35 inch, a LT tensile yield strength of at least 370 MPa and a T-L fracture toughness ($K_{app}$) of at least 80 MPa(m½).

13. An aluminum alloy product comprising:

a 2xxx aluminum alloy;

(a) wherein the aluminum alloy is recrystallized and comprises at least 60% recrystallized grains;

(b) wherein at least some of the recrystallized grains have a texture, and wherein at least some of these recrystallized grains have a brass texture;

(c) wherein the recrystallized grains having the brass texture comprise the largest fraction of the recrystallized grains having texture; and (d) wherein an area fraction of the brass texture is at least 10%.

14. The aluminum alloy product of claim 13, wherein at least some of the recrystallized grains have a Goss texture, and wherein the aluminum alloy product comprises an area fraction of Goss texture.

15. The aluminum alloy product of claim 14, wherein a ratio of the area fraction of brass texture to the area fraction of Goss texture is at least 1.5:1.

16. The aluminum alloy product of claim 14, wherein a ratio of the area fraction of brass texture to the area fraction of Goss texture is at least 1.75:1.

17. The aluminum alloy product of claim 14, wherein a ratio of the area fraction of brass texture to the area fraction of Goss texture is at least 2:1.

18. The aluminum alloy product of claim 13, wherein the aluminum alloy product comprises up to 7.0 wt % copper.

19. The aluminum alloy product of claim 18, wherein the aluminum alloy product comprises up to 4.0 wt % lithium.

20. The aluminum alloy product of claim 13, wherein the 2xxx aluminum alloy is 2199.

21. The aluminum alloy product of claim 13, wherein the aluminum alloy product is in the form of a sheet.

22. The aluminum alloy product of claim 21, wherein the sheet has a thickness of not greater than 0.35 inch, a LT tensile yield strength of at least 370 MPa and a T-L fracture toughness ($K_{app}$) of at least 80 MPa(m½).

23. The aluminum alloy product of claim 13, wherein the aluminum alloy product has a peak R-value in the range of from 40° to 60°.

* * * * *